US011306943B2

(12) United States Patent
Park et al.

(10) Patent No.: US 11,306,943 B2
(45) Date of Patent: Apr. 19, 2022

(54) TUBE ASSEMBLY FOR TUBULAR HEAT EXCHANGER, AND TUBULAR HEAT EXCHANGER COMPRISING SAME

(71) Applicant: KYUNGDONG NAVIEN CO., LTD., Pyeongtaek-si (KR)

(72) Inventors: Duck Sik Park, Seoul (KR); Jun Kyu Park, Seoul (KR); Sung Jun Ahn, Seoul (KR); Young Bae Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 318 days.

(21) Appl. No.: 16/329,255

(22) PCT Filed: Sep. 7, 2017

(86) PCT No.: PCT/KR2017/009835

§ 371 (c)(1),
(2) Date: Feb. 28, 2019

(87) PCT Pub. No.: WO2018/048226

PCT Pub. Date: Mar. 15, 2018

(65) Prior Publication Data

US 2019/0249902 A1 Aug. 15, 2019

(30) Foreign Application Priority Data

Sep. 9, 2016 (KR) ..... 10-2016-0116360
Sep. 9, 2016 (KR) ..... 10-2016-0116363
Oct. 21, 2016 (KR) ..... 10-2016-0137834

(51) Int. Cl.
*F24H 9/00* (2006.01)
*F28F 1/40* (2006.01)
(Continued)

(52) U.S. Cl.
CPC ..... *F24H 9/00* (2013.01); *F28D 7/16* (2013.01); *F28D 21/00* (2013.01);
(Continued)

(58) Field of Classification Search
CPC ..... F28D 7/16; F28D 21/00; F28D 21/0015; F28F 13/12; F28F 1/40; F28F 1/02; F28F 1/04; F28F 9/24; F24H 9/00
(Continued)

(56) References Cited

U.S. PATENT DOCUMENTS 3,783,938 A * 1/1974 Chartet ..... F28F 13/12 165/166
5,271,376 A * 12/1993 Lu ..... F28F 21/065 126/11 OR
(Continued)

FOREIGN PATENT DOCUMENTS

EP 2437022 A2 4/2012
EP 2508834 A2 10/2012
(Continued)

OTHER PUBLICATIONS

International Search Report of PCT/KR2017/009835, dated Dec. 5, 2017, English translation.

*Primary Examiner* — Tho V Duong
(74) *Attorney, Agent, or Firm* — STIP Law Group, LLC

(57) ABSTRACT

The purpose of the present invention is to provide a tube assembly for a tubular heat exchanger and a tubular heat exchanger comprising the same, the tube assembly for a tubular heat exchanger being capable of enhancing efficiency in heat exchange between a heat medium and a combustion gas and also preventing high-temperature oxidation and the burn-out of a turbulator caused by the combustion heat of the combustion gas and preventing the deformation or damage of a tube which may occur in an
(Continued)

environment with a high water pressure, thereby improving the durability thereof. The tube assembly for a tubular heat exchanger of the present invention, for achieving the purpose, comprises: a tube which is formed in a flat shape and enables a combustion gas generated in a combustion chamber to flow along the inside thereof and exchange heat with a heat medium which flows outside thereof; and a turbulator which is coupled to the inside of the tube and induces the generation of turbulence in the flow of the combustion gas.

16 Claims, 53 Drawing Sheets

(51) Int. Cl.

| | |
|---|---|
| ***F28F 9/24*** | (2006.01) |
| ***F28F 13/12*** | (2006.01) |
| ***F28D 7/16*** | (2006.01) |
| ***F28F 1/04*** | (2006.01) |
| ***F28F 1/02*** | (2006.01) |
| ***F28D 21/00*** | (2006.01) |

(52) U.S. Cl.
CPC ..... *F28D 21/0015* (2013.01); *F28F 1/02* (2013.01); *F28F 1/04* (2013.01); *F28F 1/40* (2013.01); *F28F 9/24* (2013.01); *F28F 13/12* (2013.01)

(58) Field of Classification Search
USPC ..... 165/109.1
See application file for complete search history.

(56) References Cited

U.S. PATENT DOCUMENTS

| | | | | |
|---|---|---|---|---|
| 6,513,583 | B1 * | 2/2003 | Hughes | F28D 7/1607 165/159 |
| RE39,309 | E * | 10/2006 | McNamara | A47J 37/1247 99/403 |
| 2006/0016582 | A1 * | 1/2006 | Hashimoto | F28D 7/1684 165/109.1 |
| 2015/0308756 | A1 * | 10/2015 | Lee | F28F 1/40 165/109.1 |

FOREIGN PATENT DOCUMENTS

| | | | | |
|---|---|---|---|---|
| FR | 2512940 | A1 * | 3/1983 | F28F 1/02 |
| JP | 05096772 | U | 12/1993 | |
| JP | 2004317072 | A | 11/2004 | |
| JP | 2006038304 | A | 2/2006 | |
| KR | 1020060083487 | A | 7/2006 | |
| KR | 1020090017174 | A | 2/2009 | |
| KR | 101400833 | B4 | 5/2014 | |
| WO | WO2009078577 | A1 | 6/2009 | |

* cited by examiner

[FIG.1]
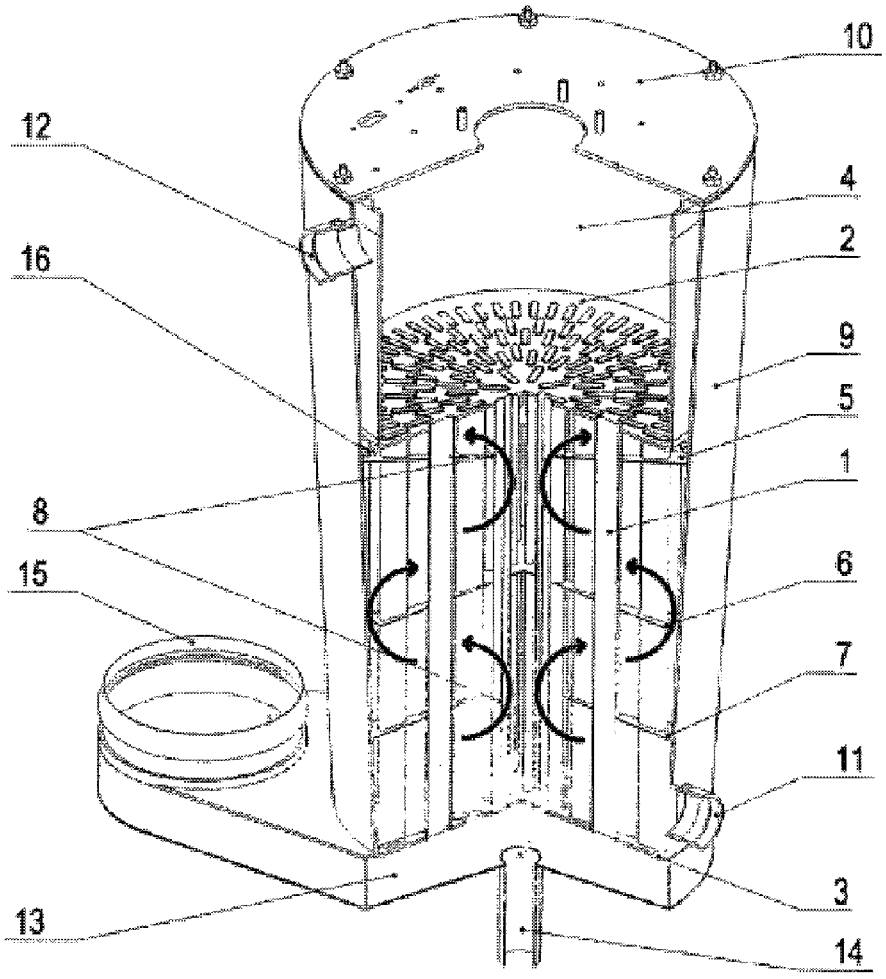

[FIG.2]
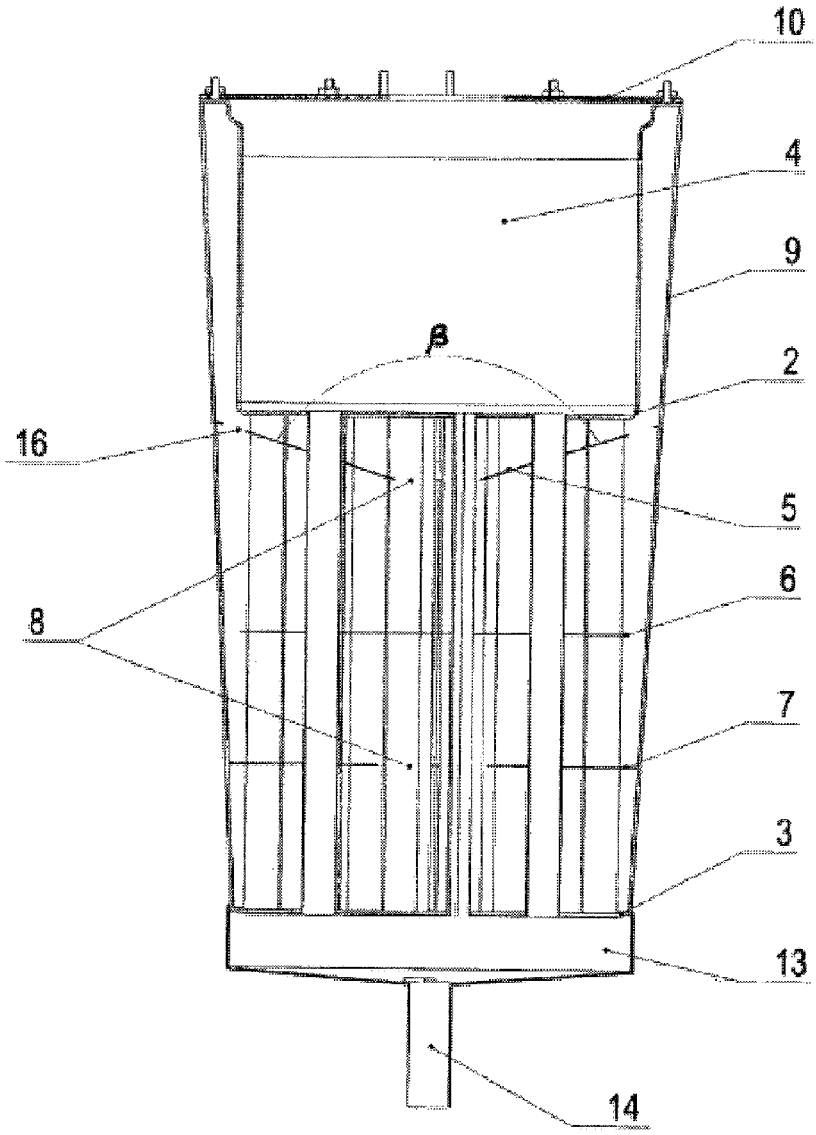

[FIG.3]
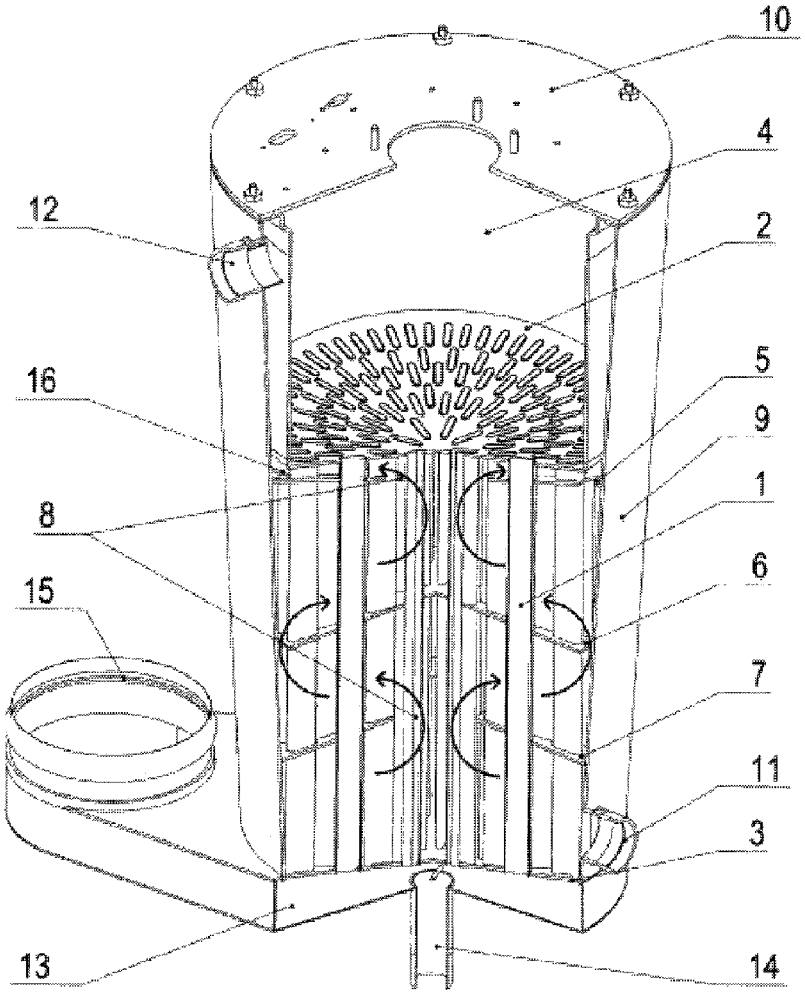

[FIG.4]
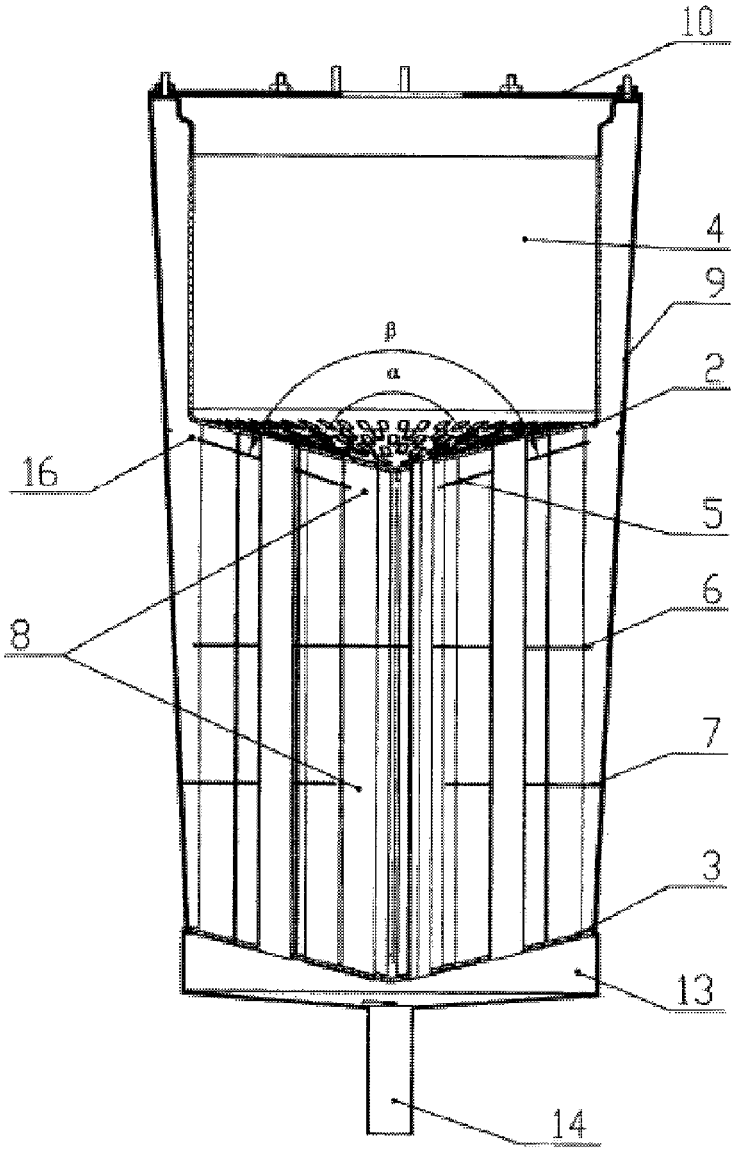

[FIG.5]
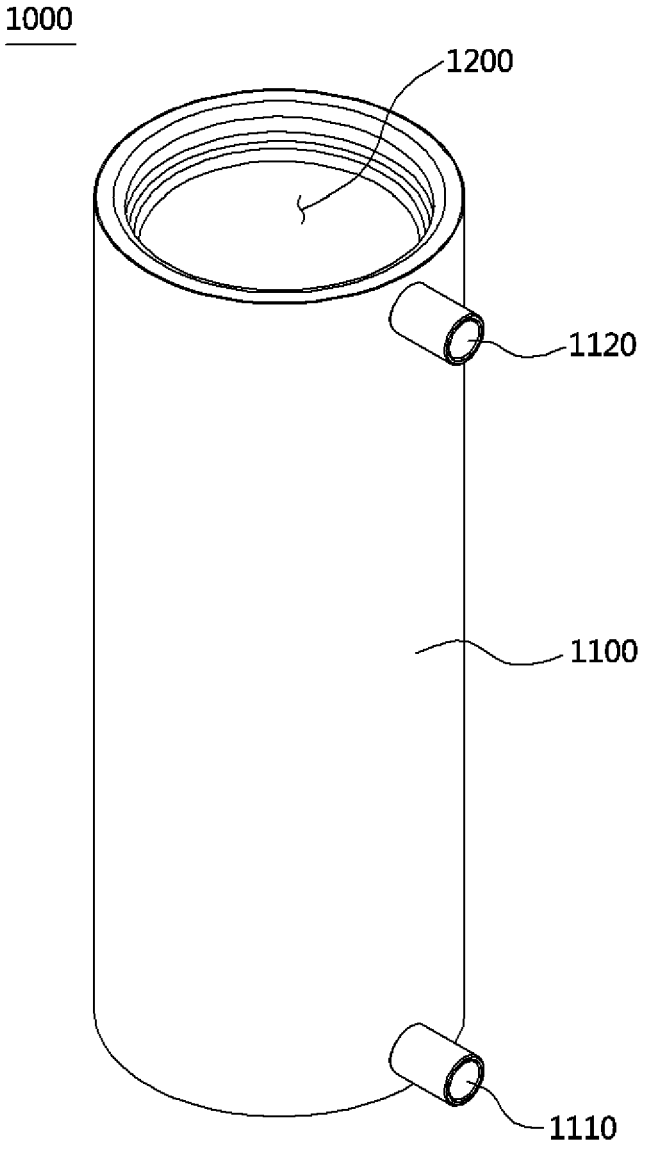

[FIG.6]
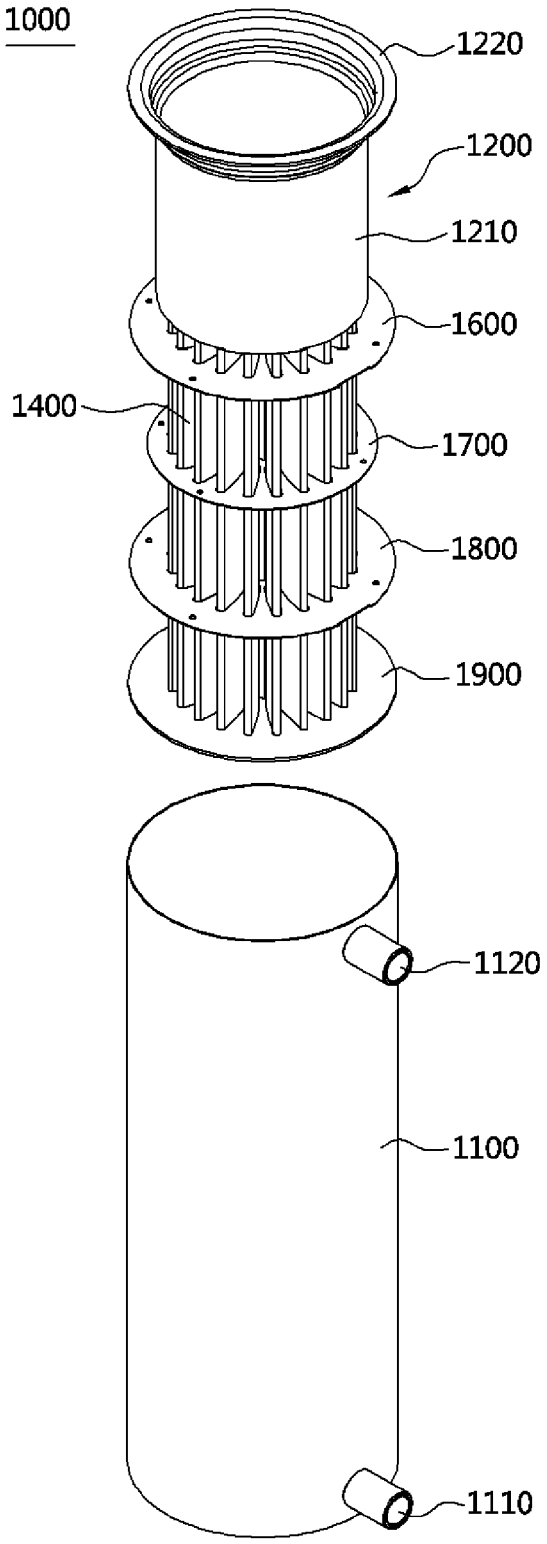

[FIG.7]
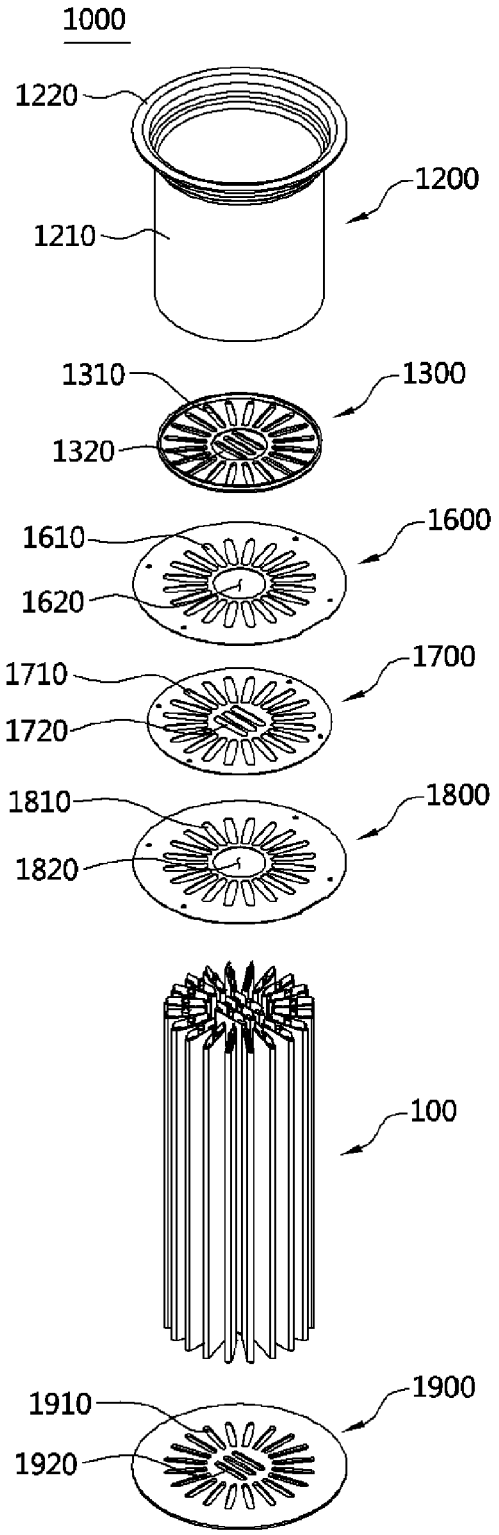

[FIG.8]
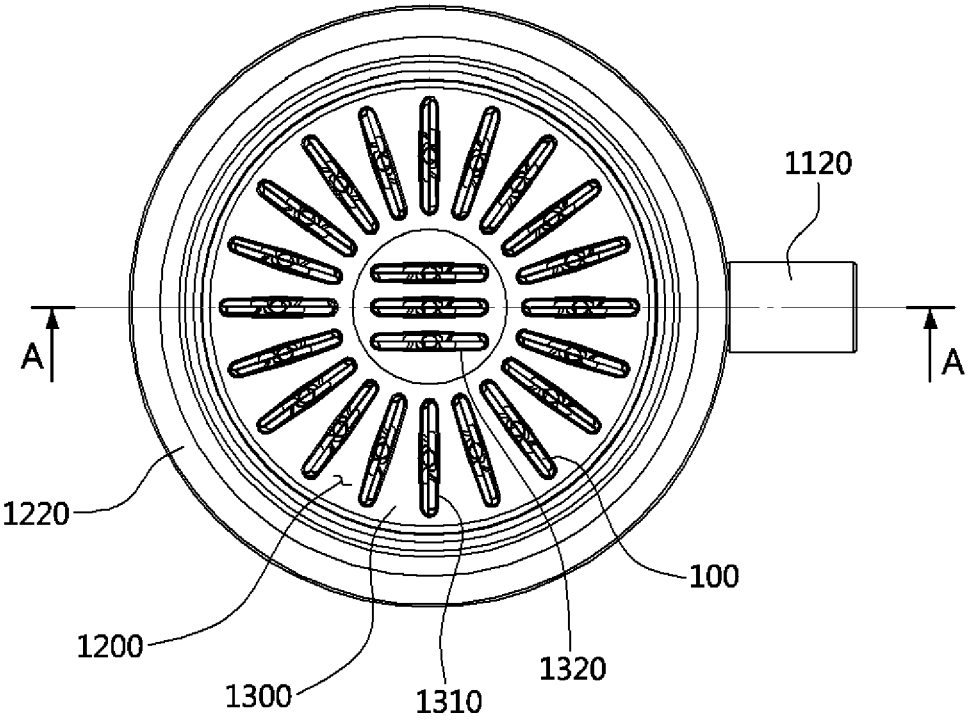

[FIG.9]
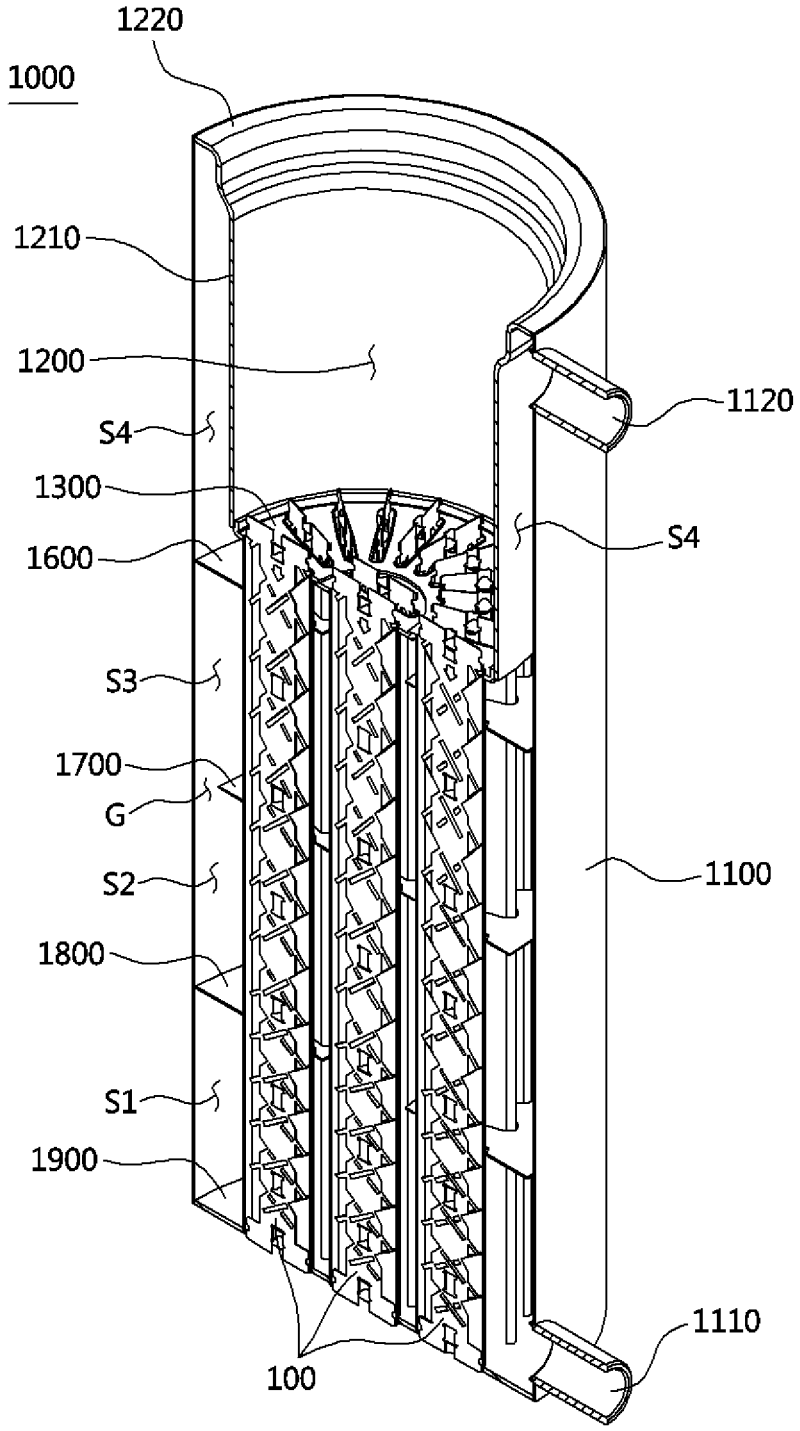

[FIG.10]
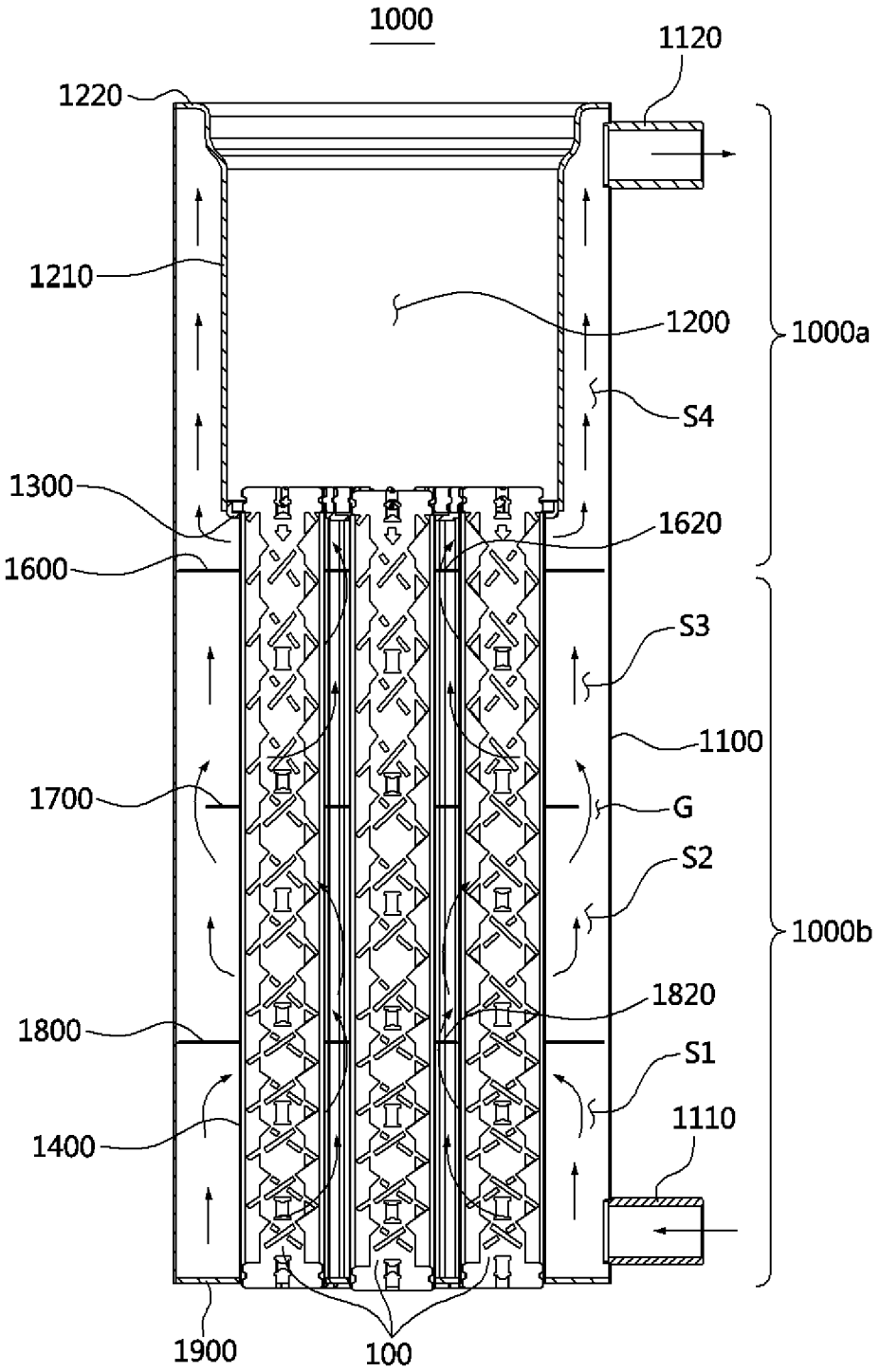

[FIG.11]
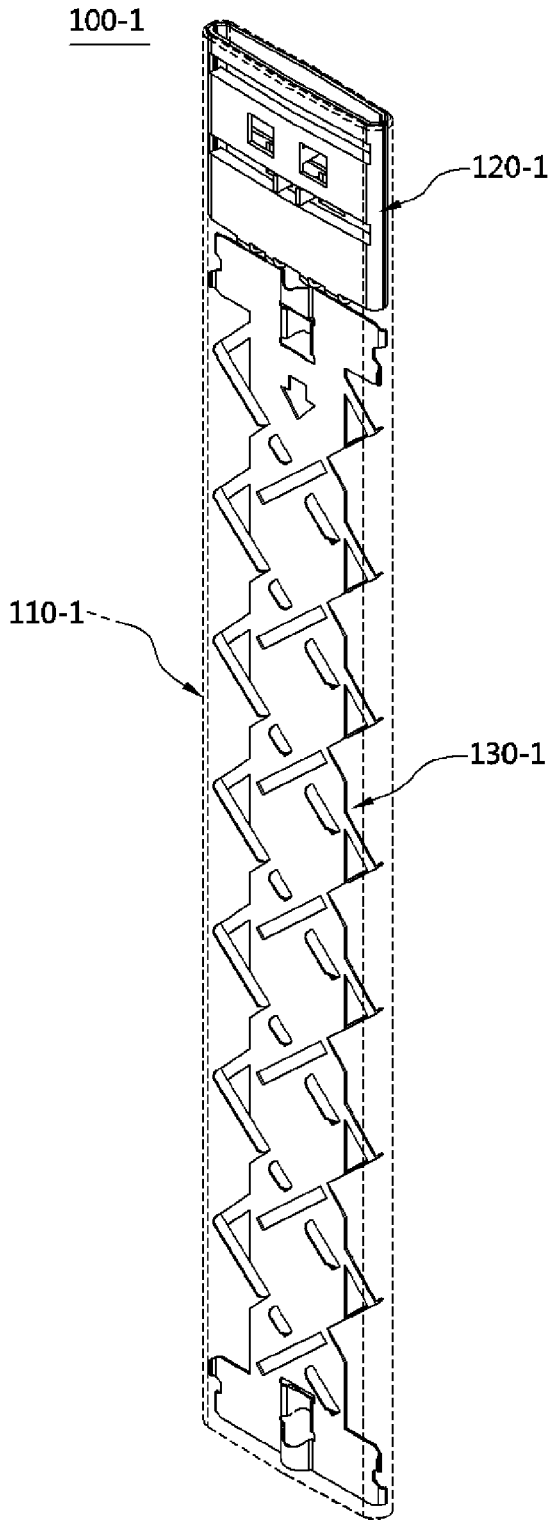

[FIG.12]
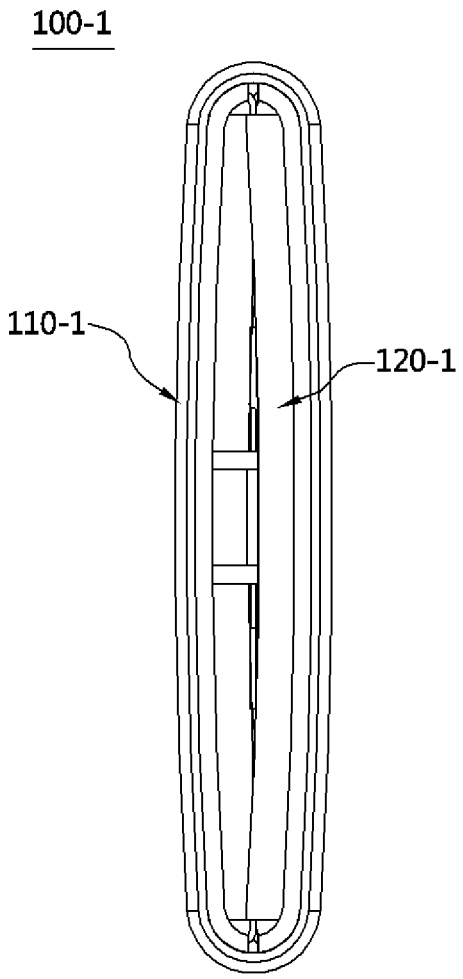

[FIG.13]
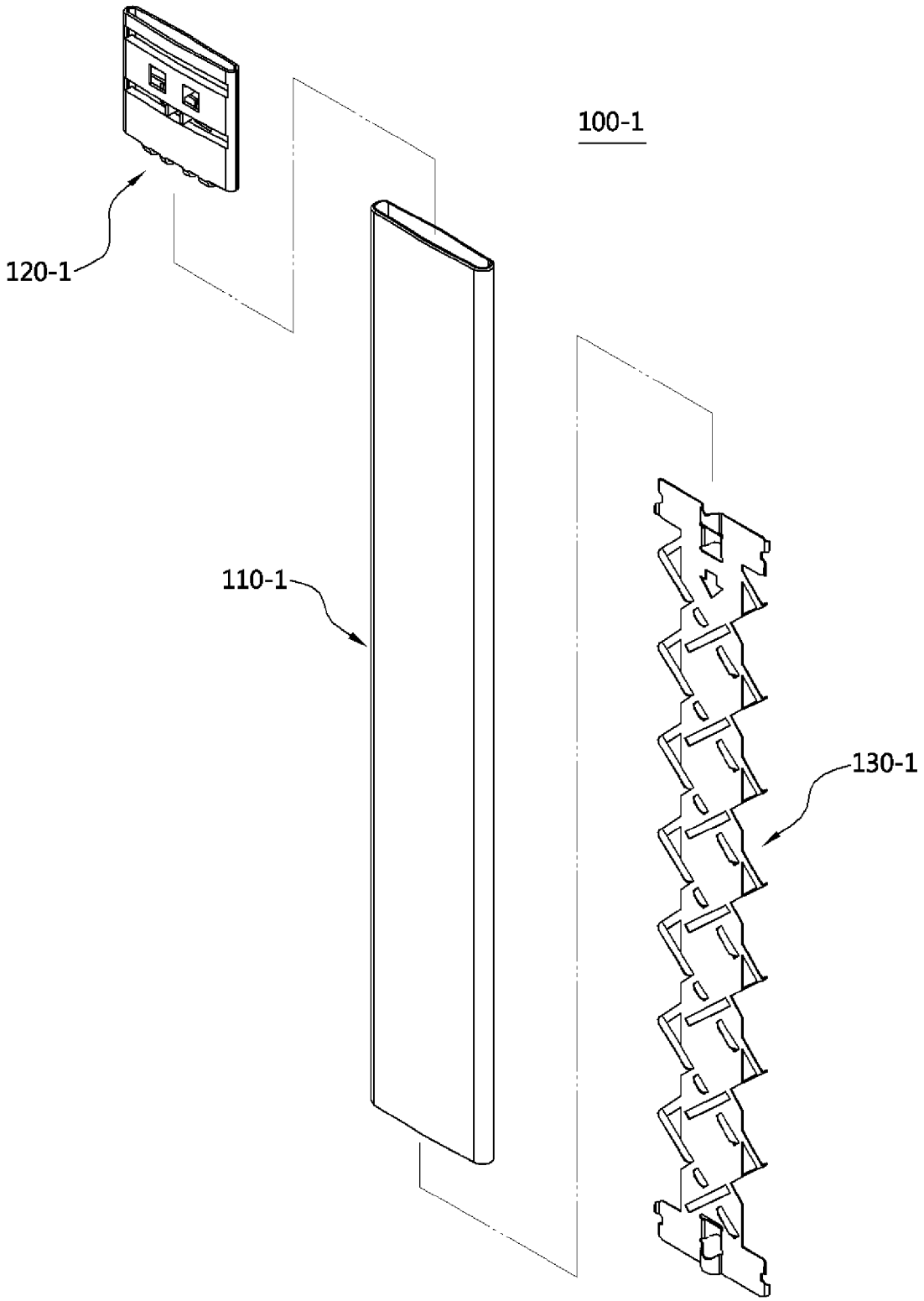

[FIG.14]
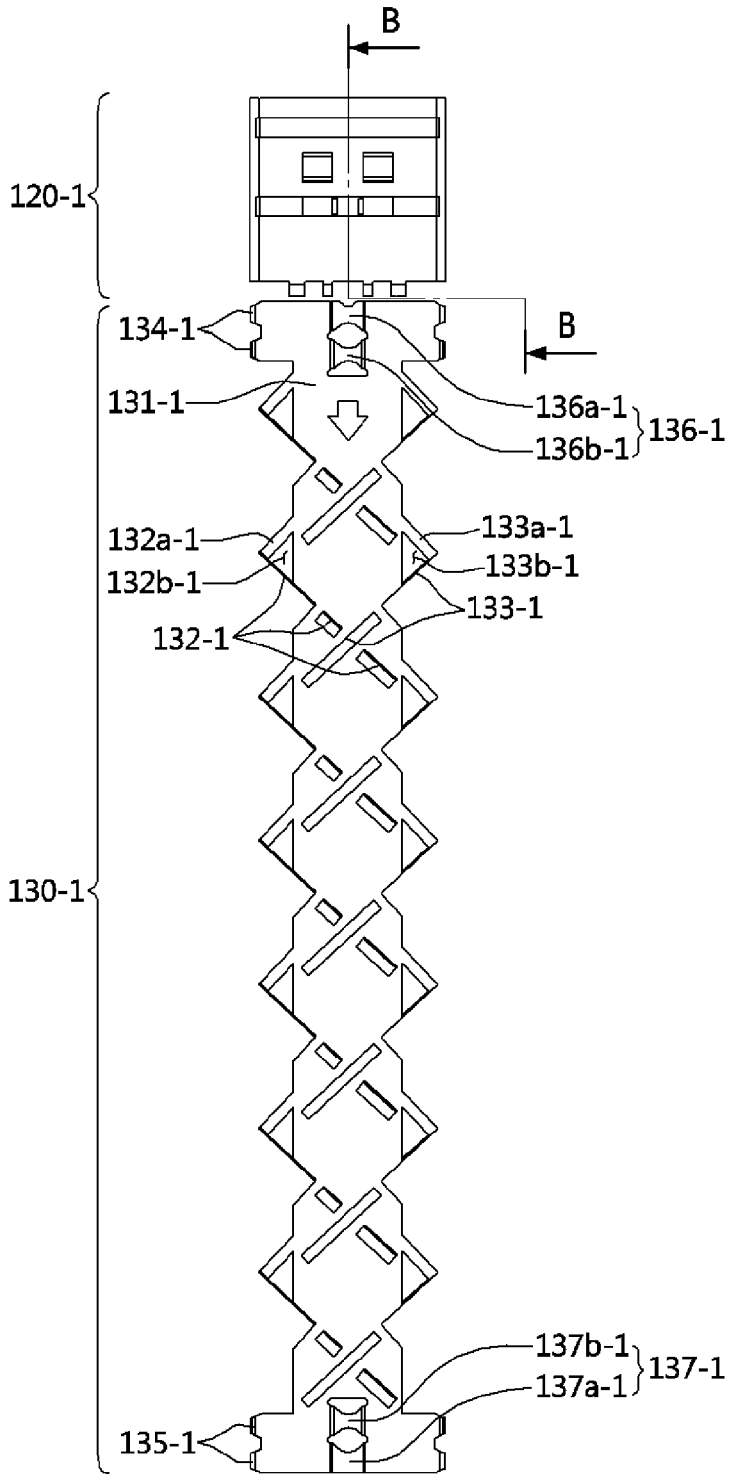

[FIG.15A]
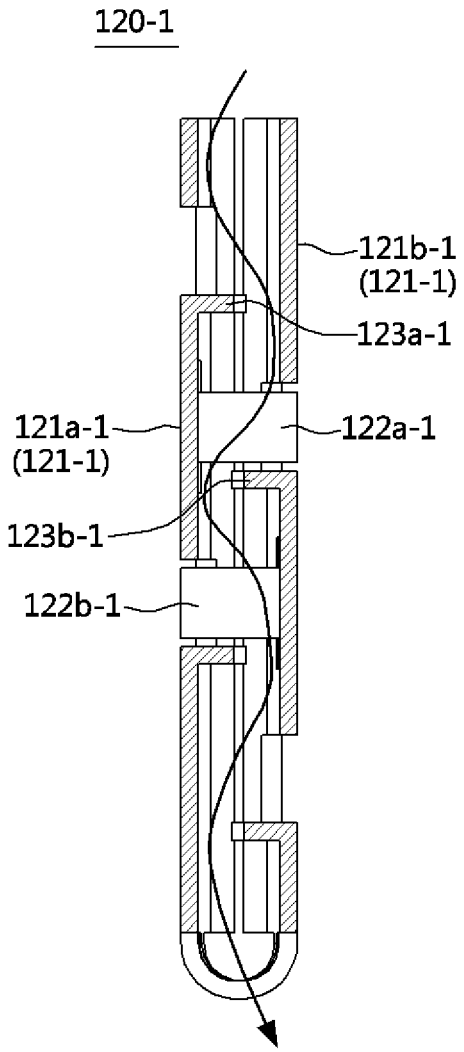

[FIG.15B]
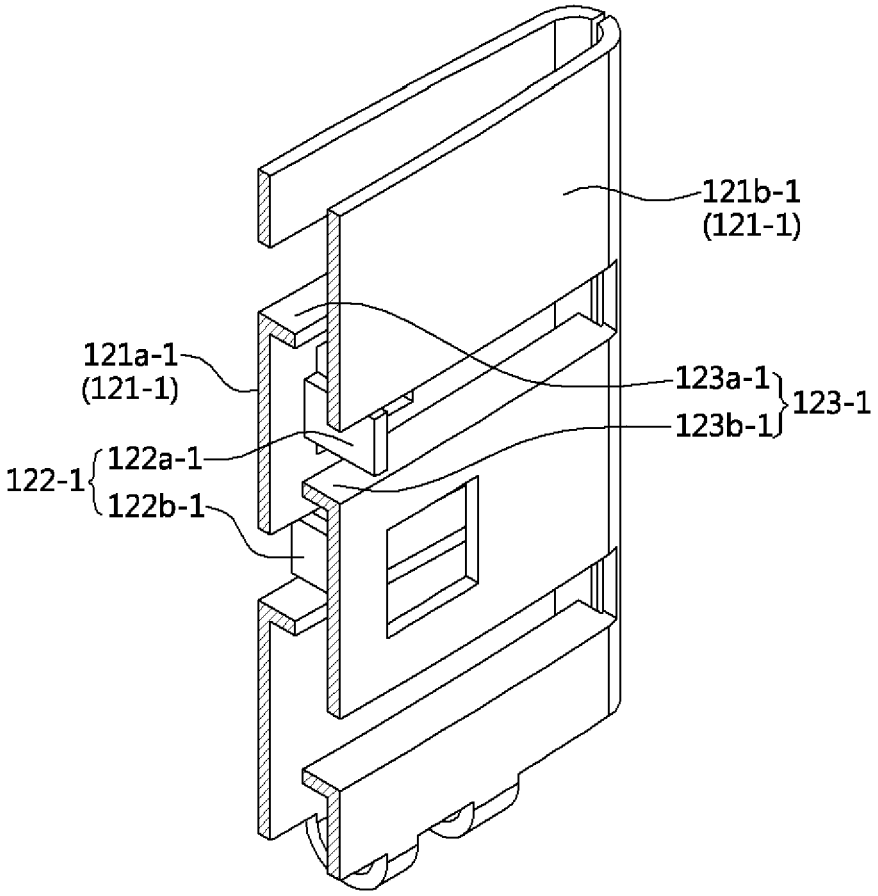

[FIG.16A]
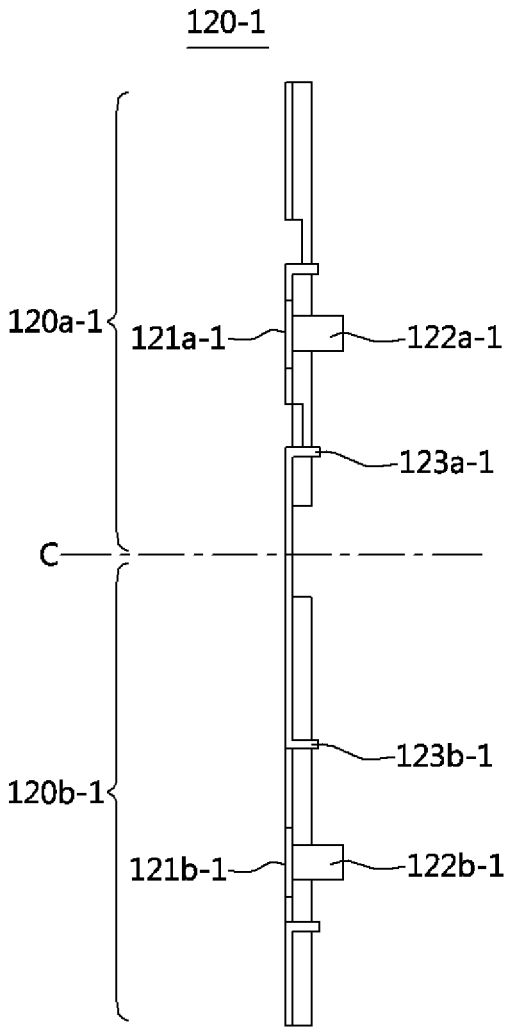

[FIG.16B]
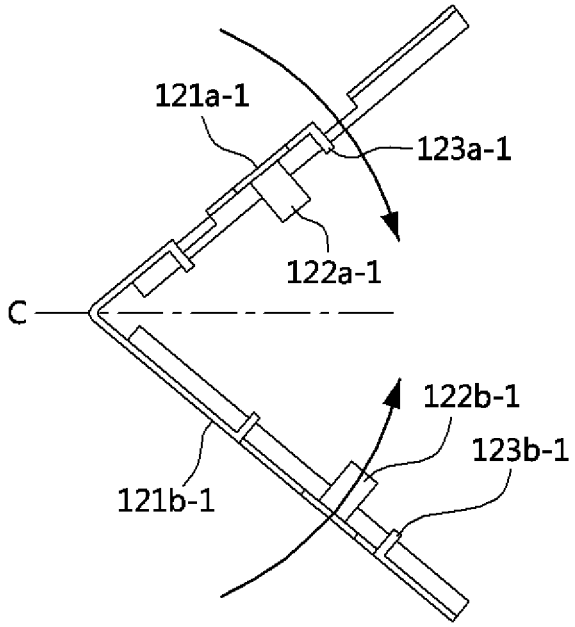

[FIG.17]
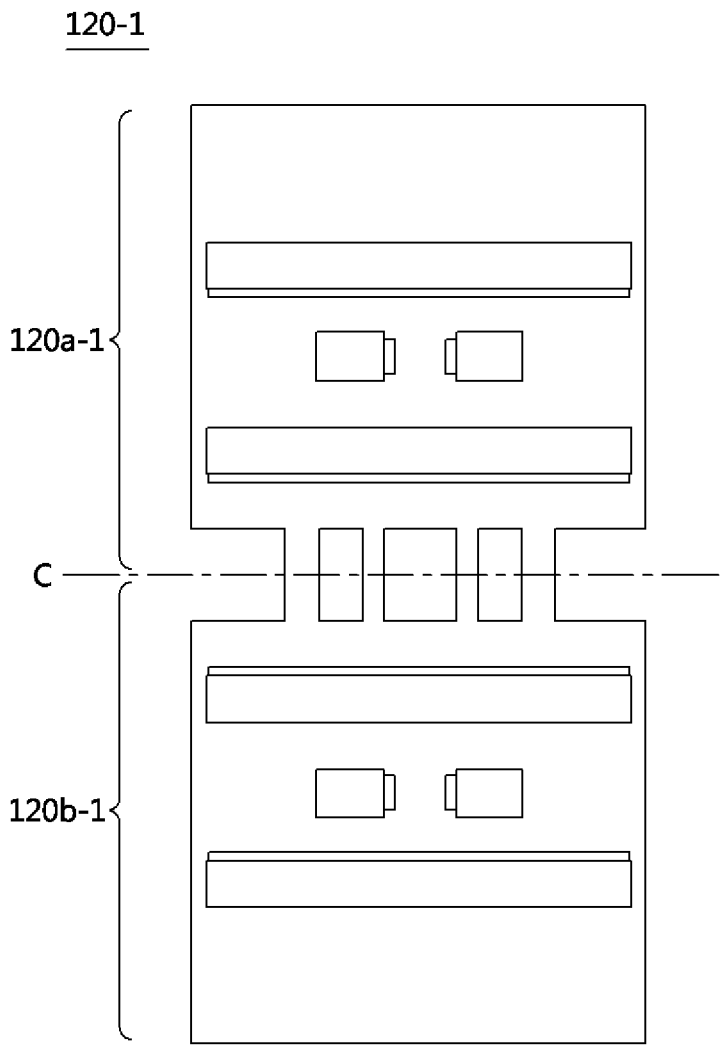

[FIG.18]
120-1-1(100-2)
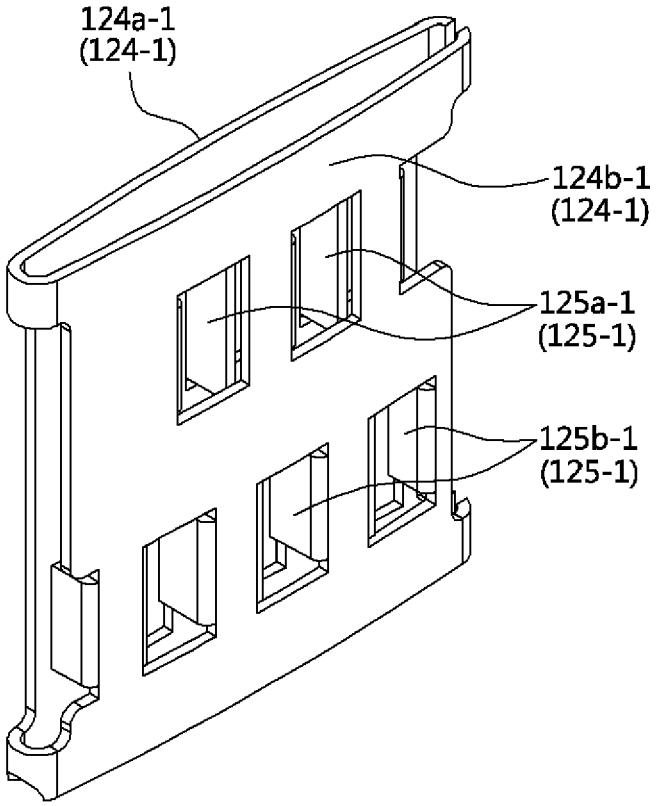

[FIG.19]
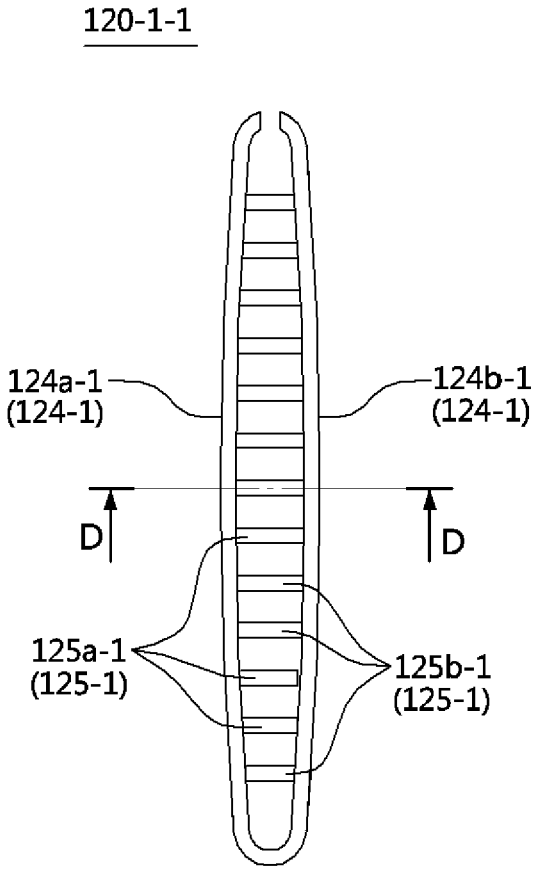

[FIG.20A]
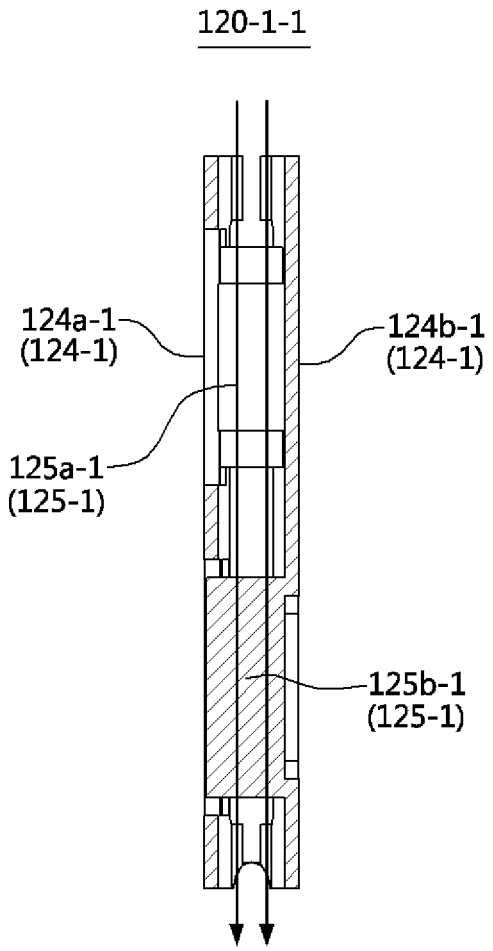

[FIG.20B]
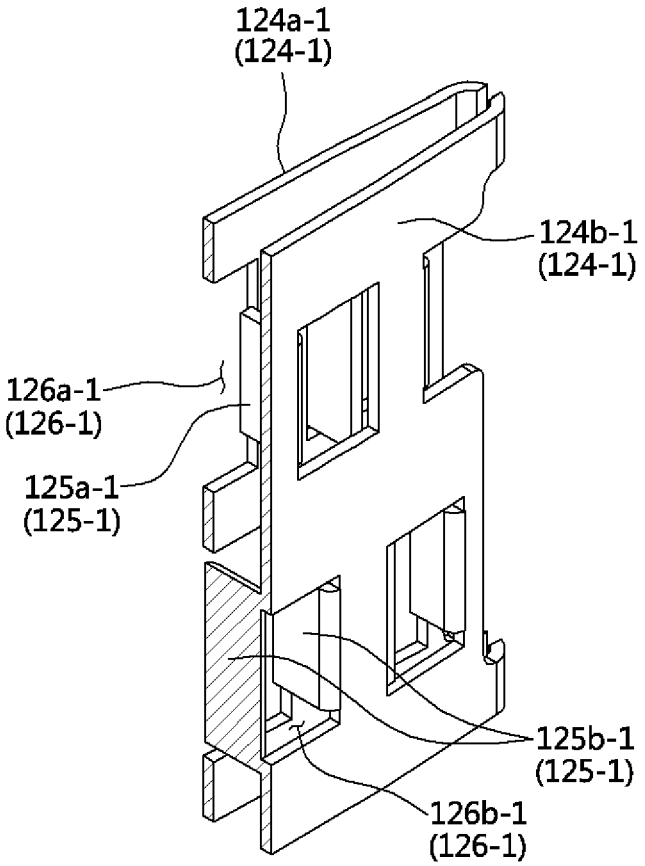

[FIG.21]
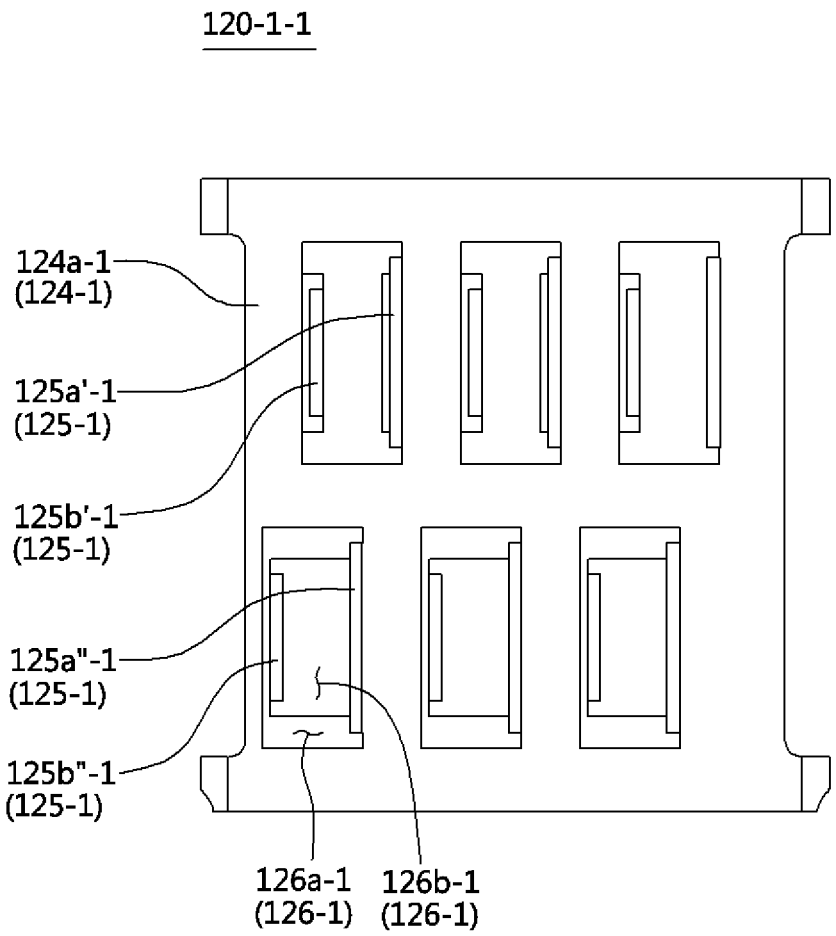

[FIG.22]
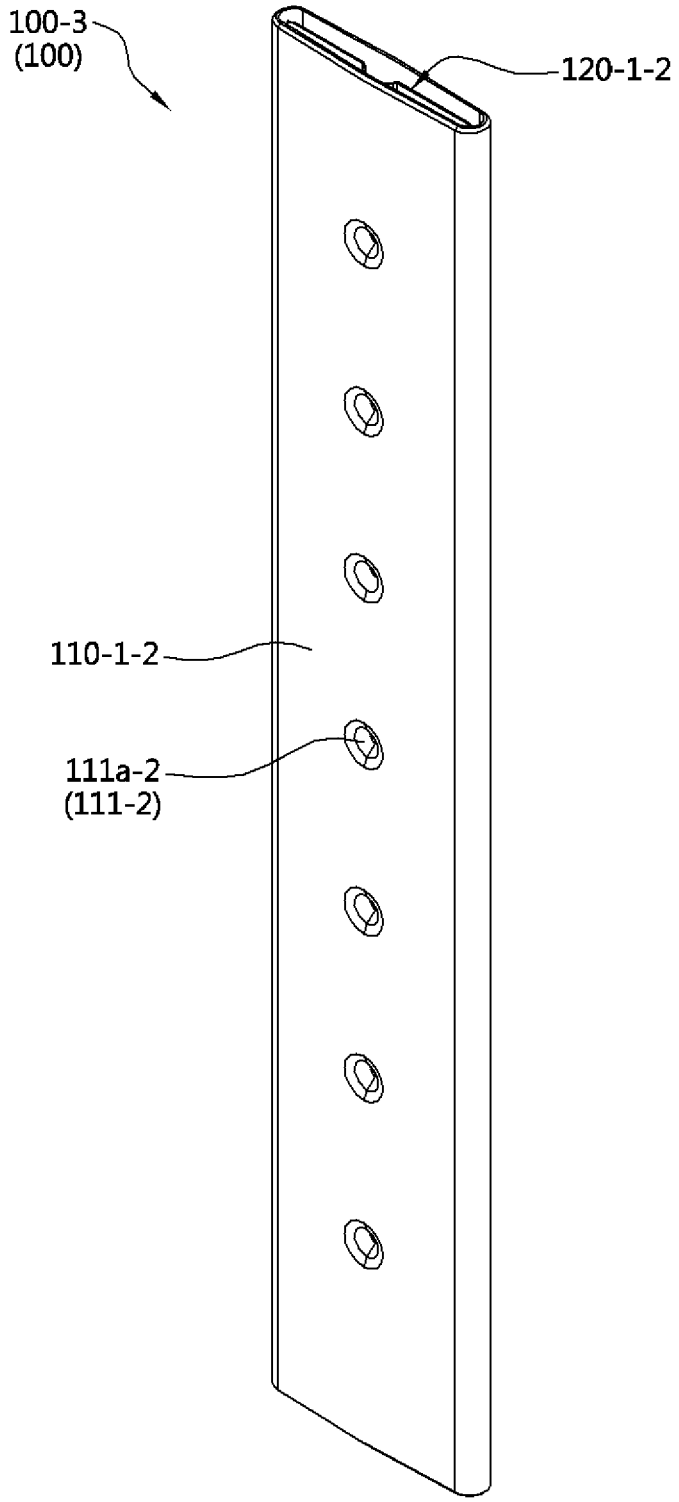

[FIG.23]
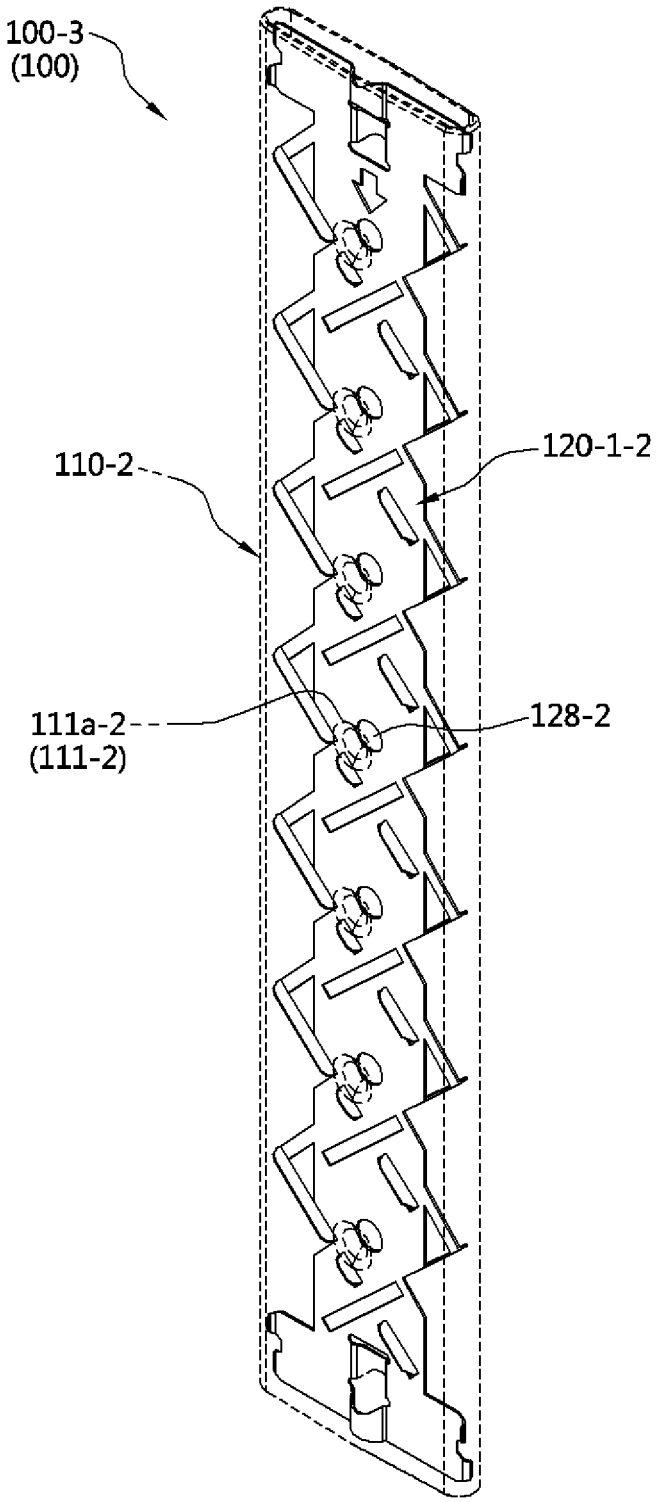

[FIG.24]
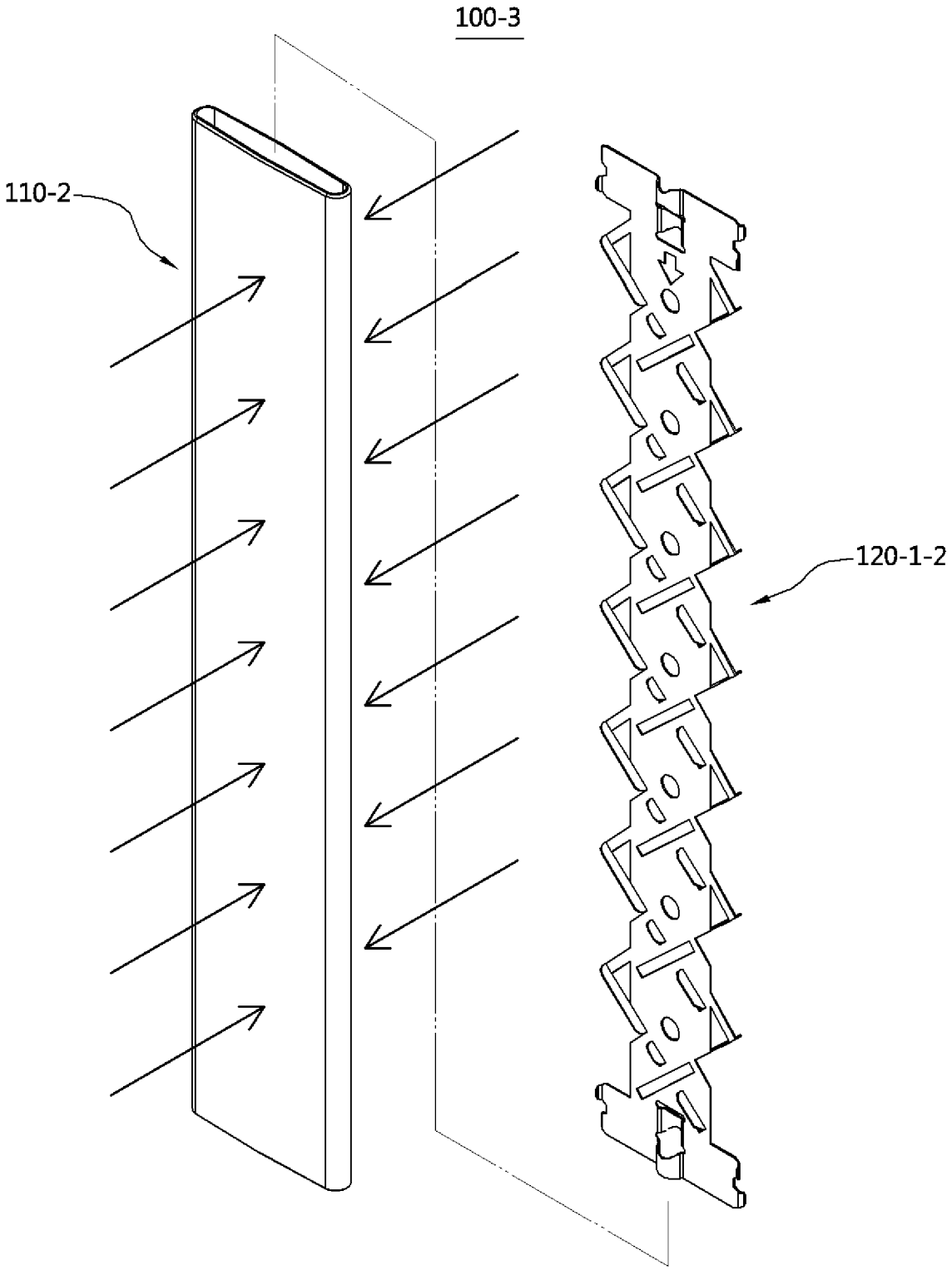

[FIG.25]
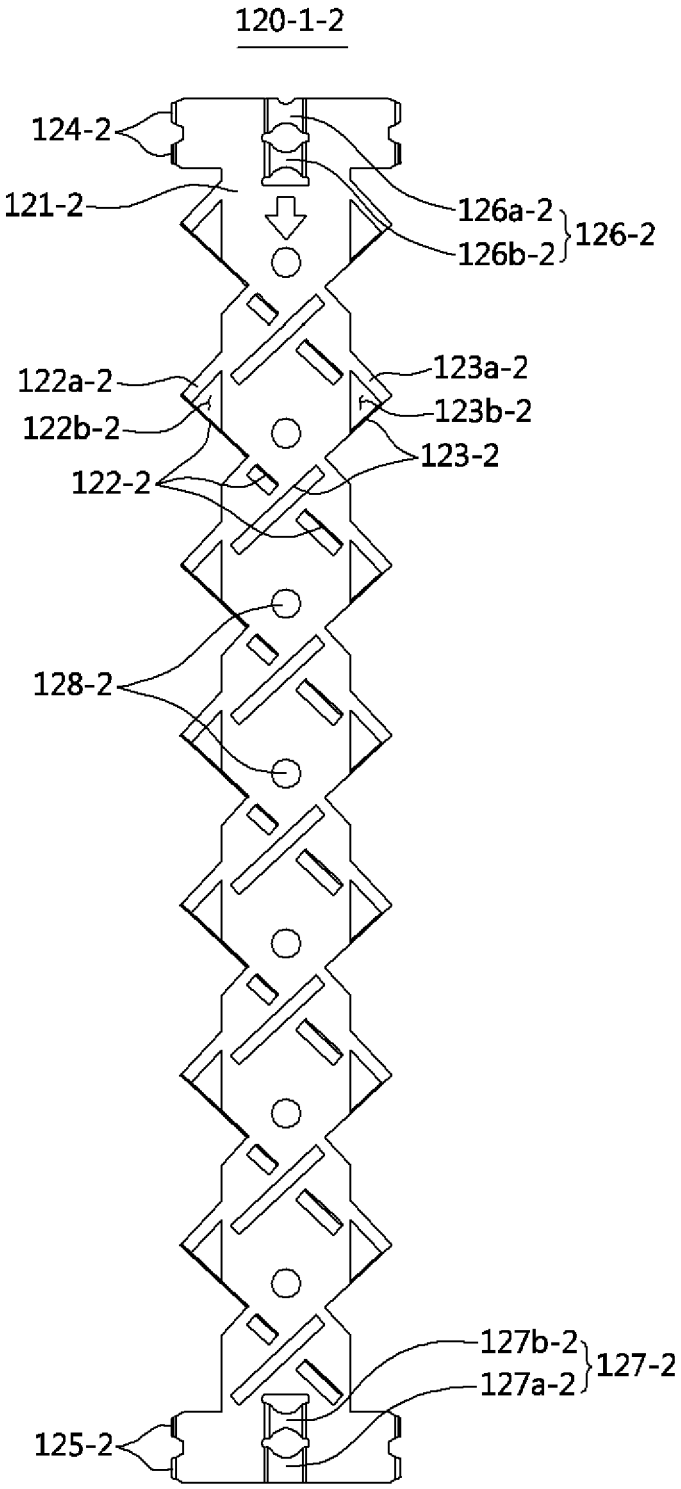

[FIG.26A]
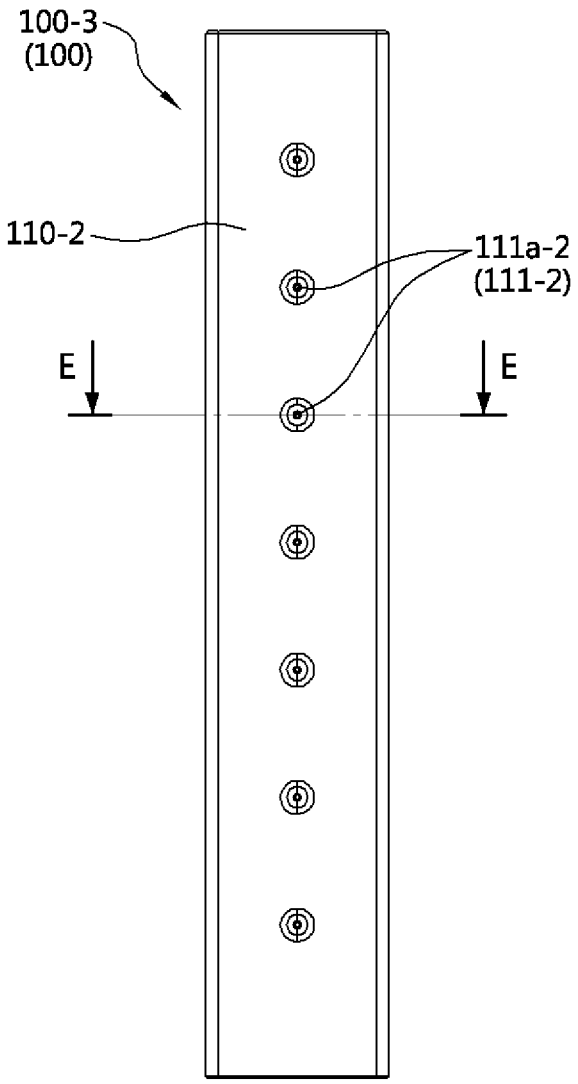

[FIG.26B]
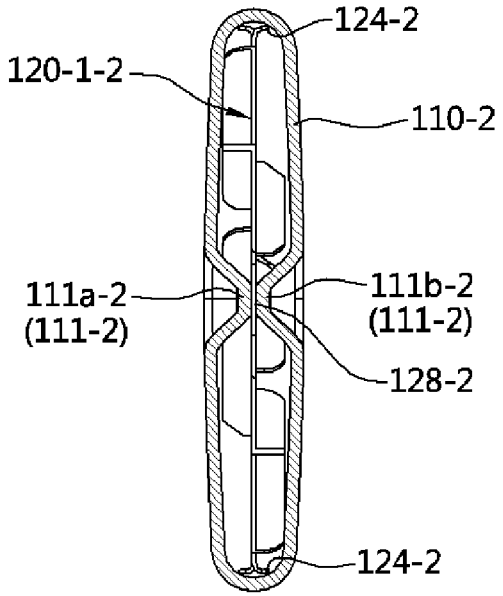

[FIG.27]
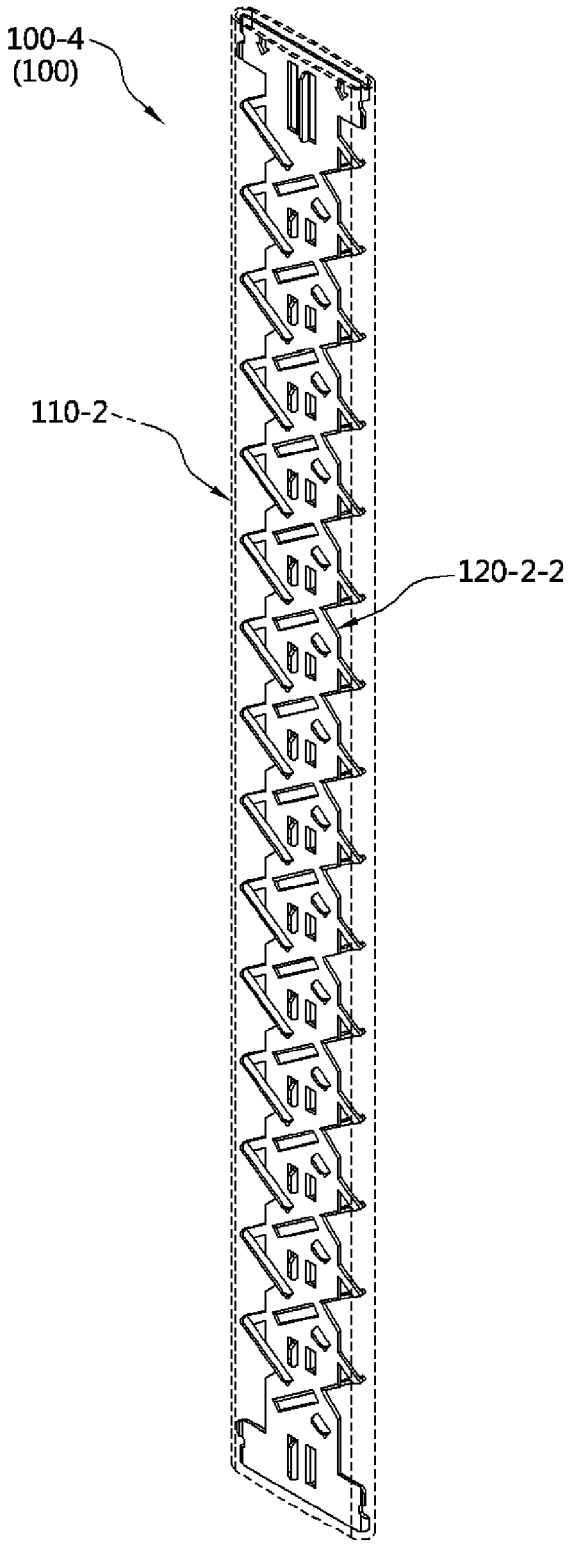

[FIG.28]
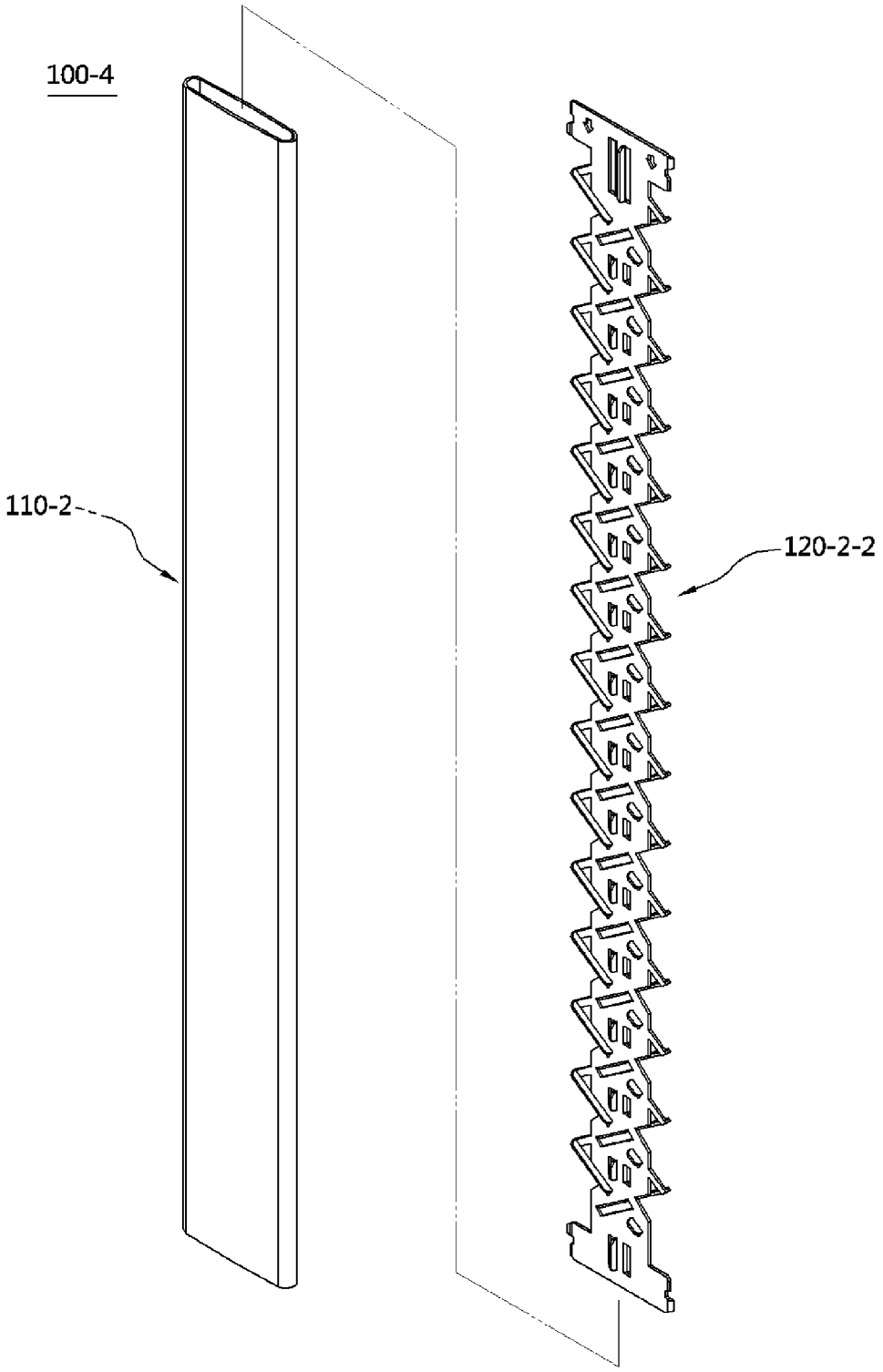

[FIG.29]
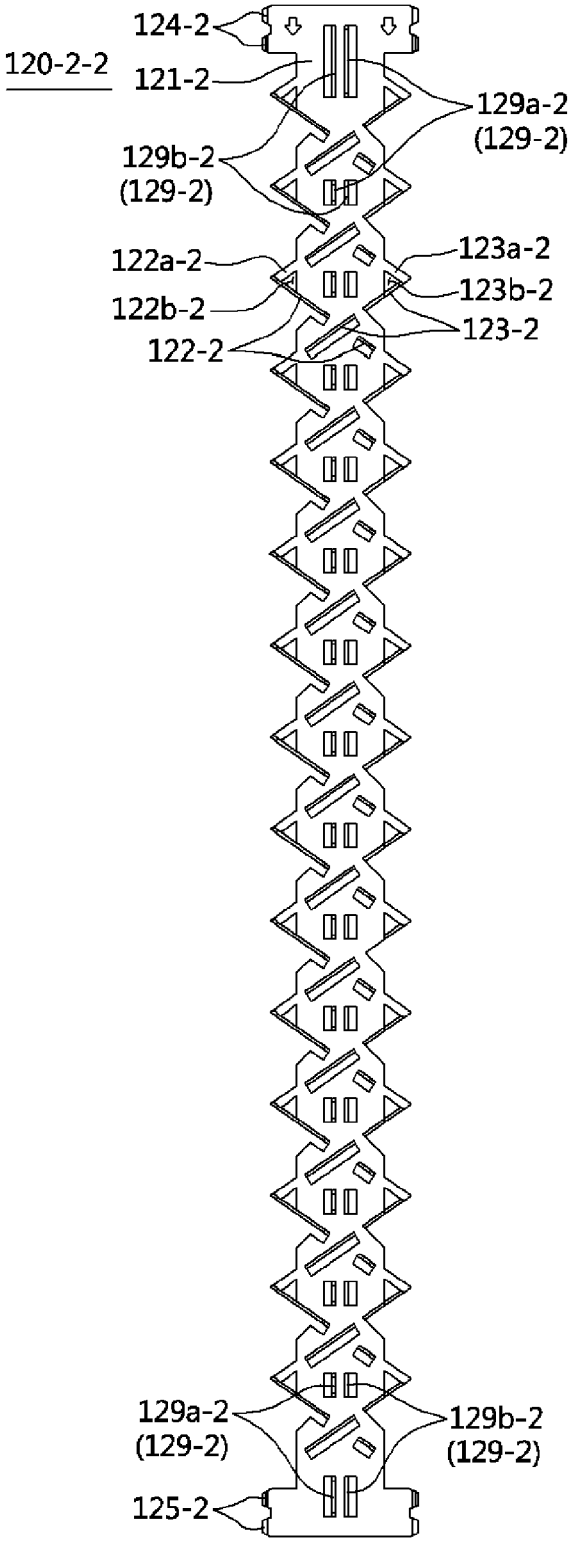

[FIG.30]
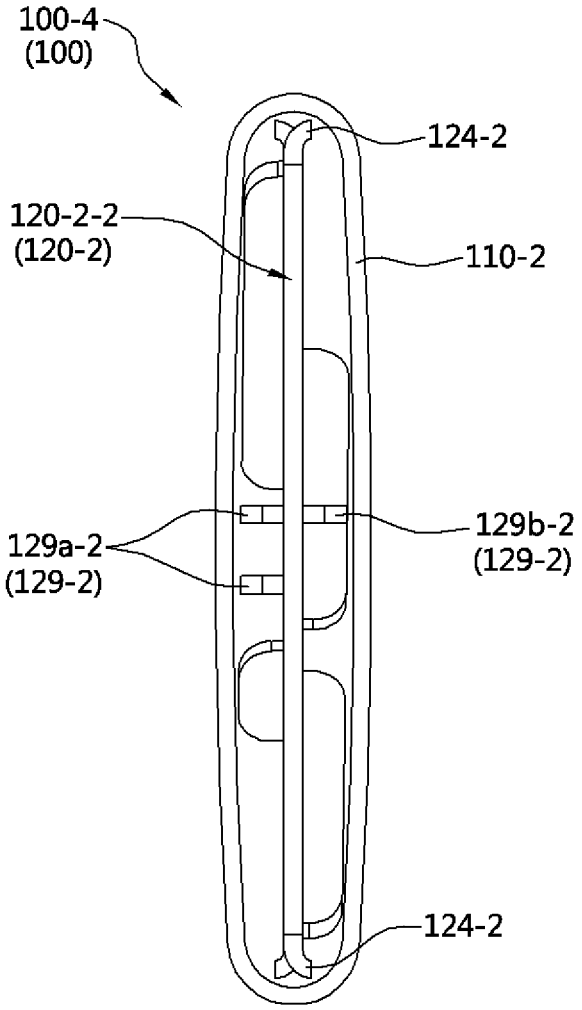

[FIG.31]
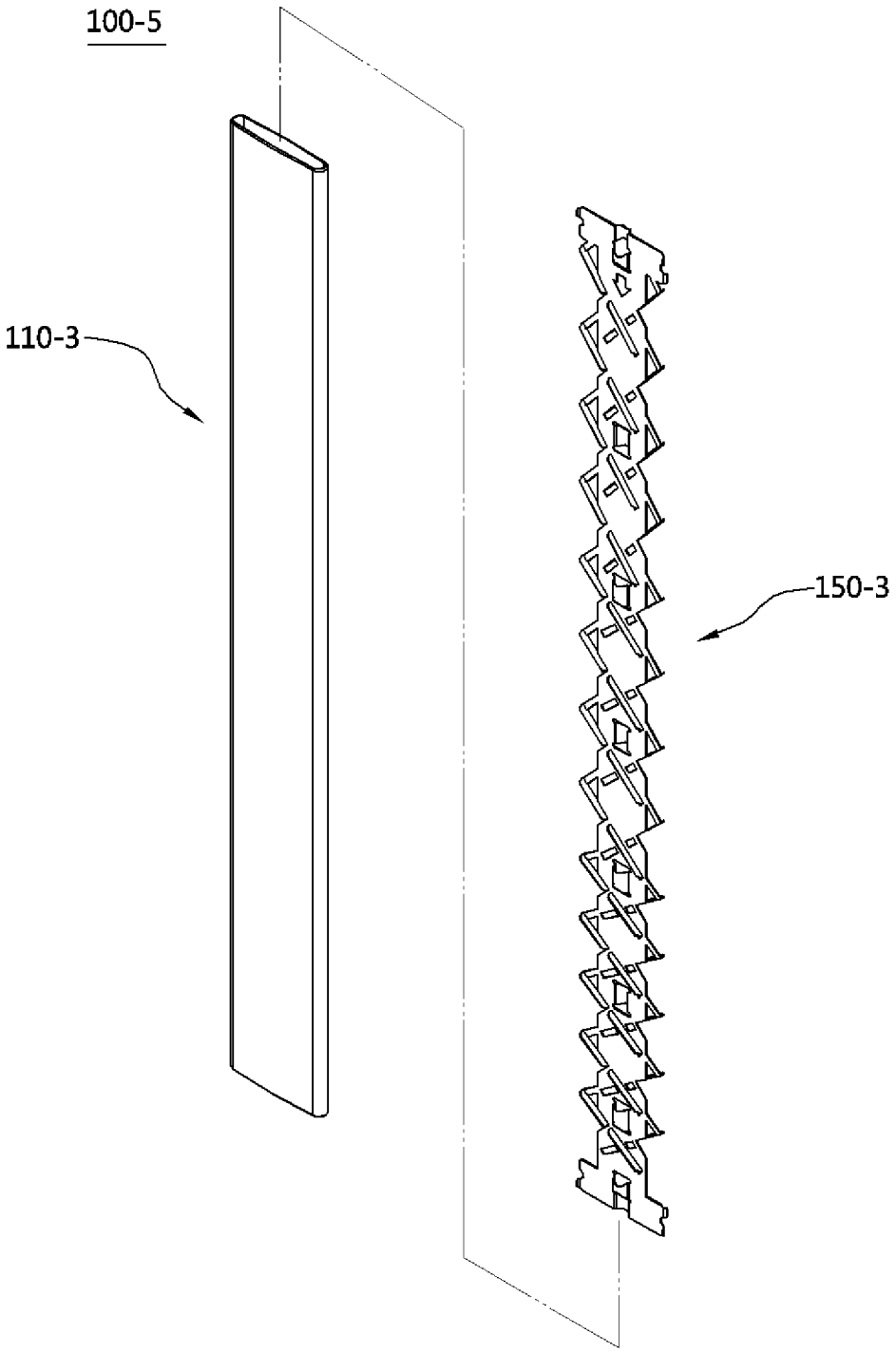

[FIG.32A]
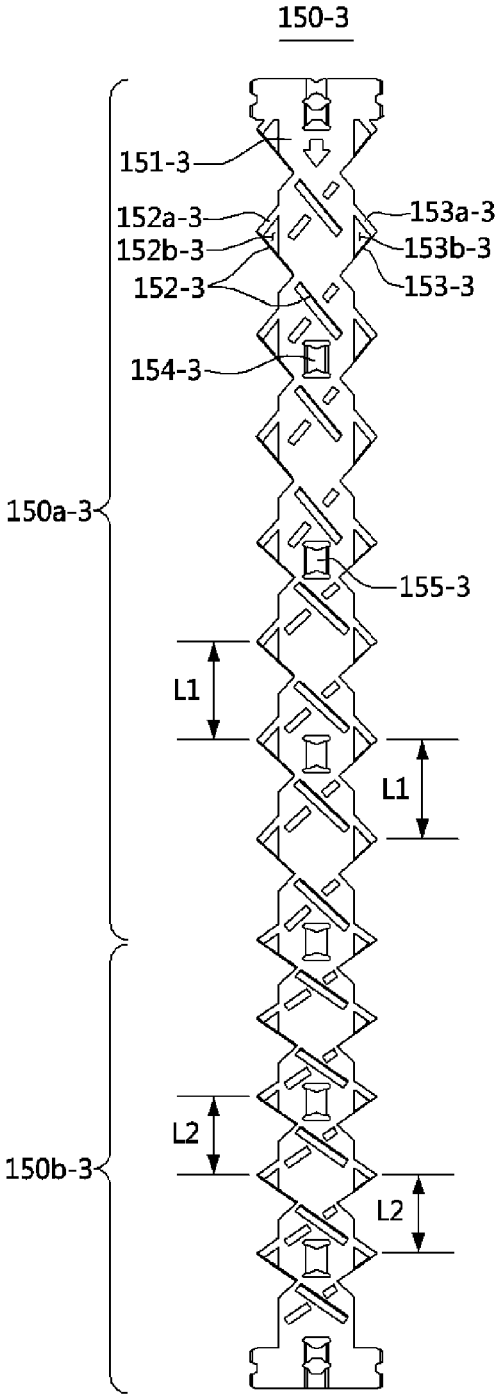

[FIG.32B]
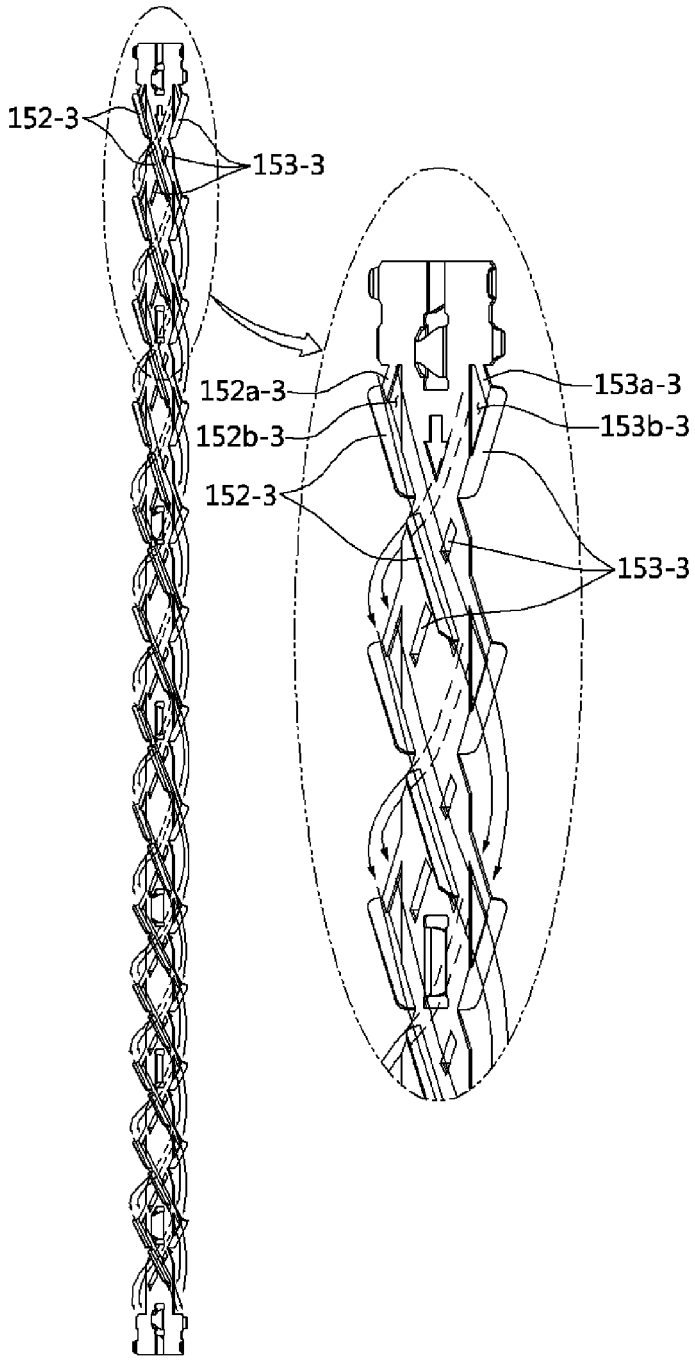

[FIG.33]
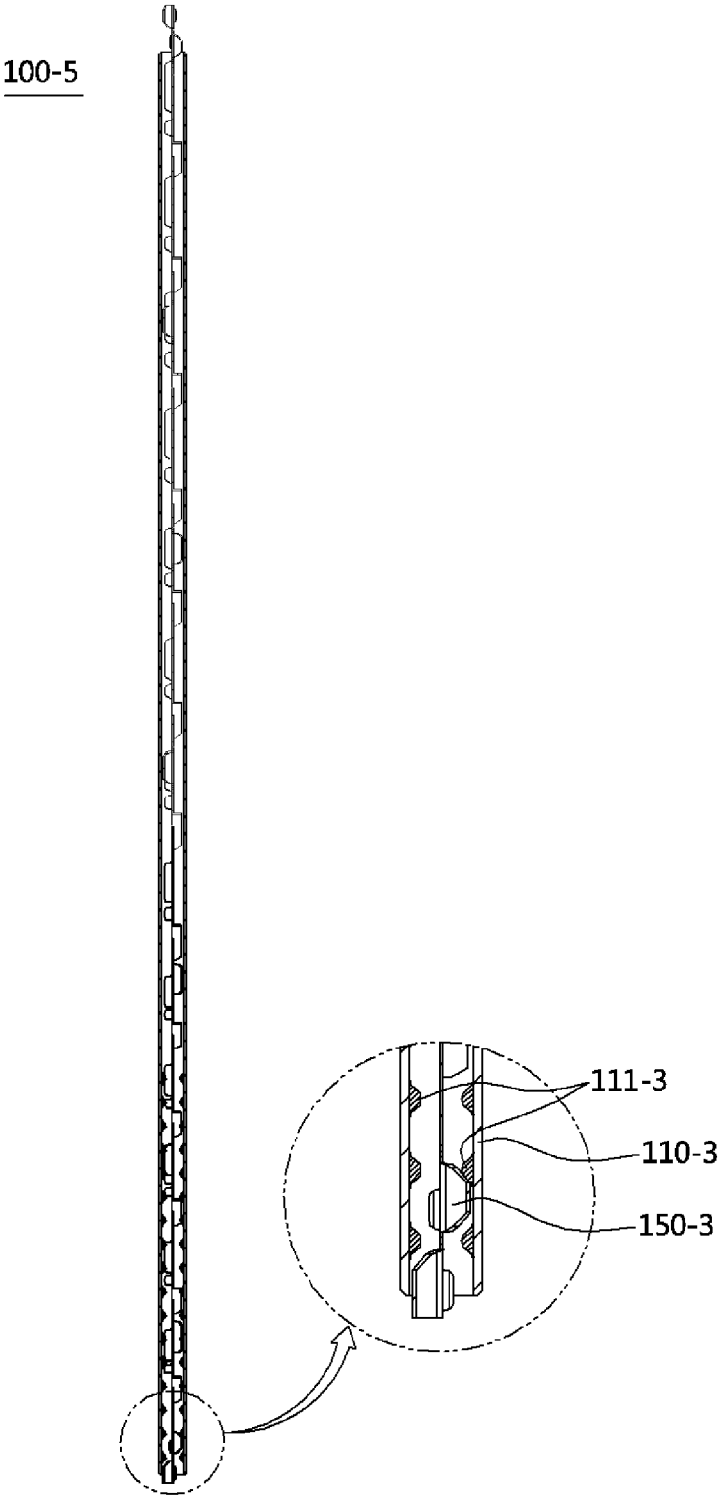

[FIG.34A]
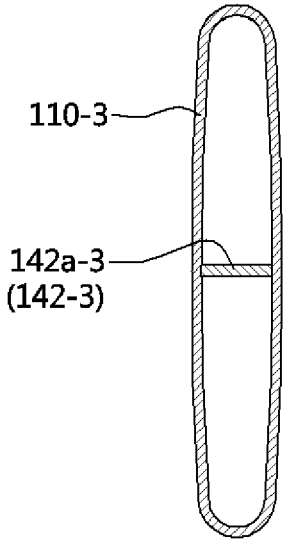
[FIG.34B]
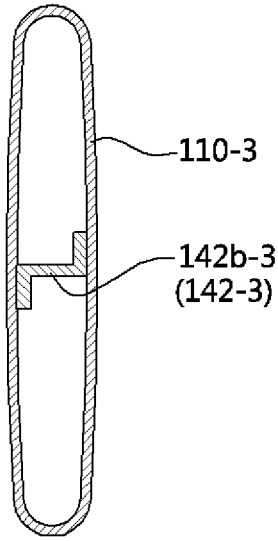

[FIG.34C]
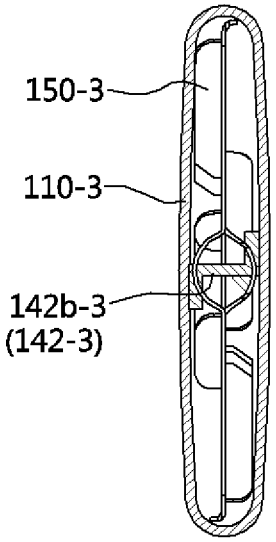
[FIG.34D]
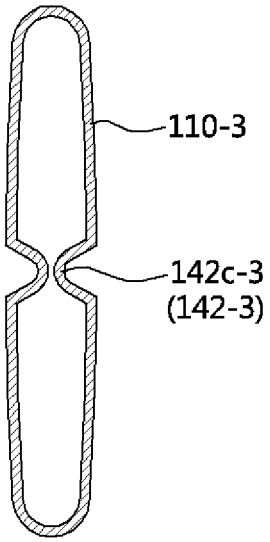

[FIG.35]
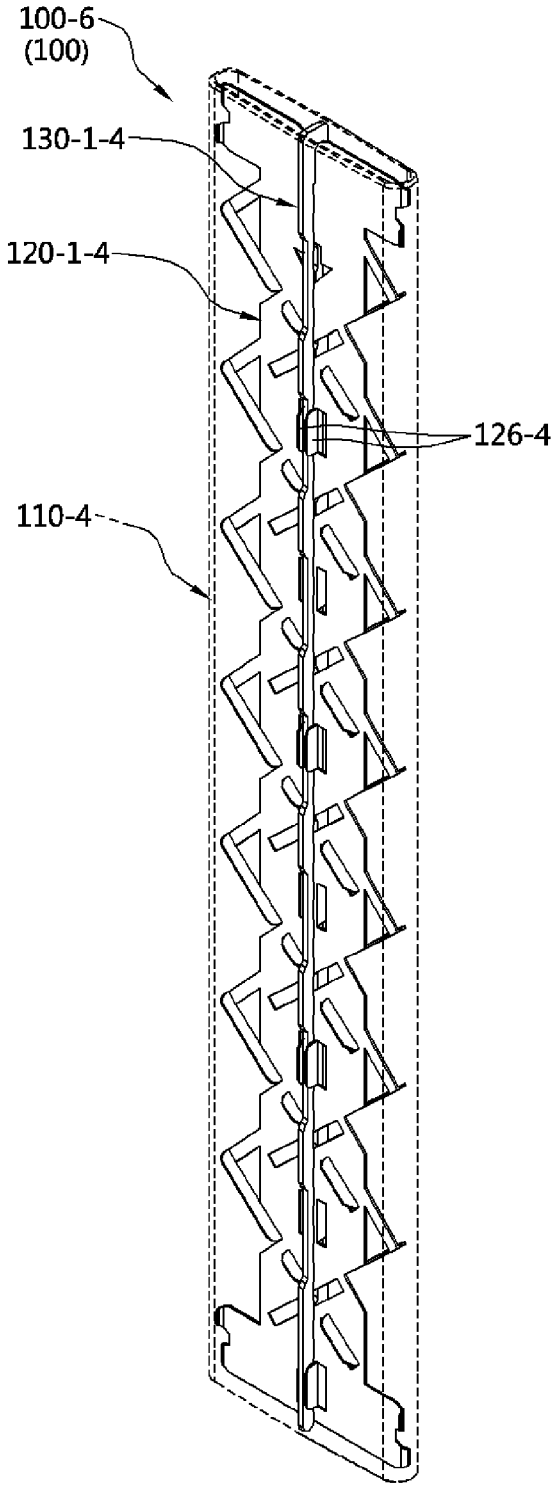

[FIG.36]
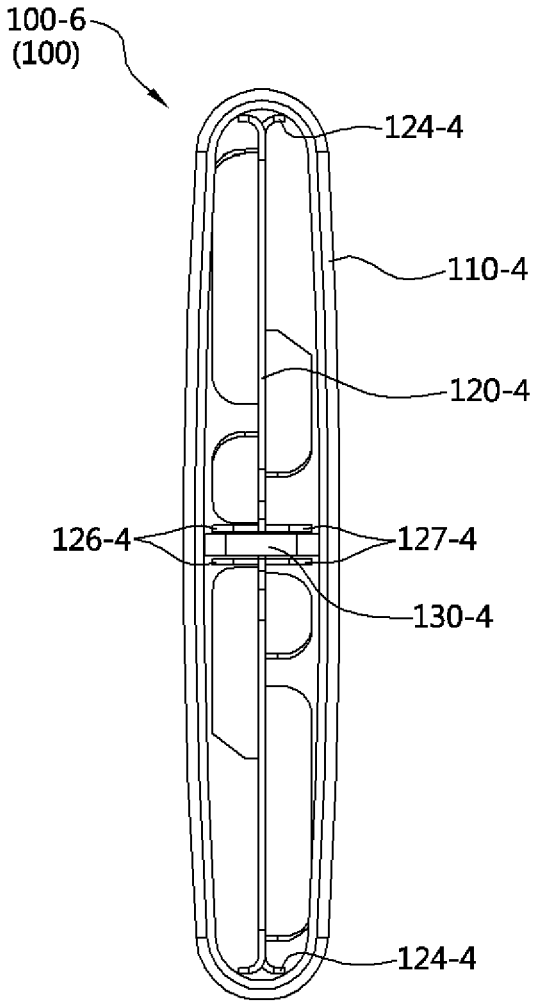

[FIG.37]
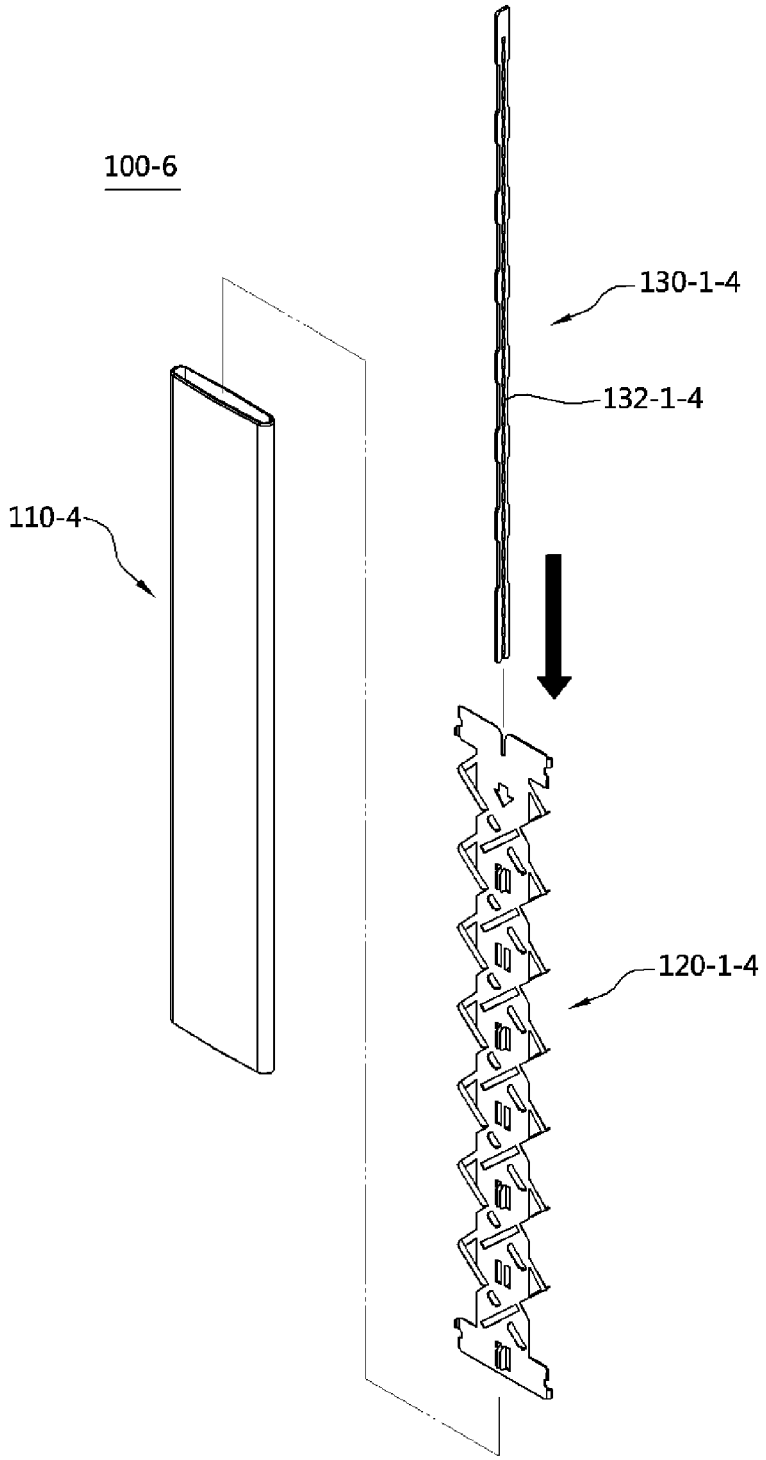

[FIG.38A]
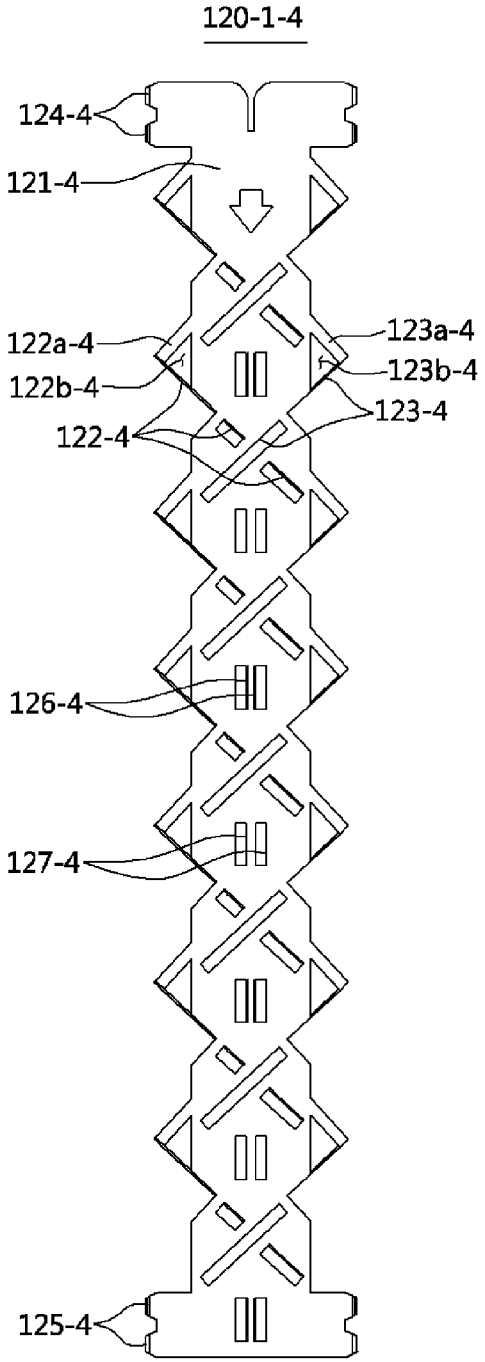

[FIG.38B]
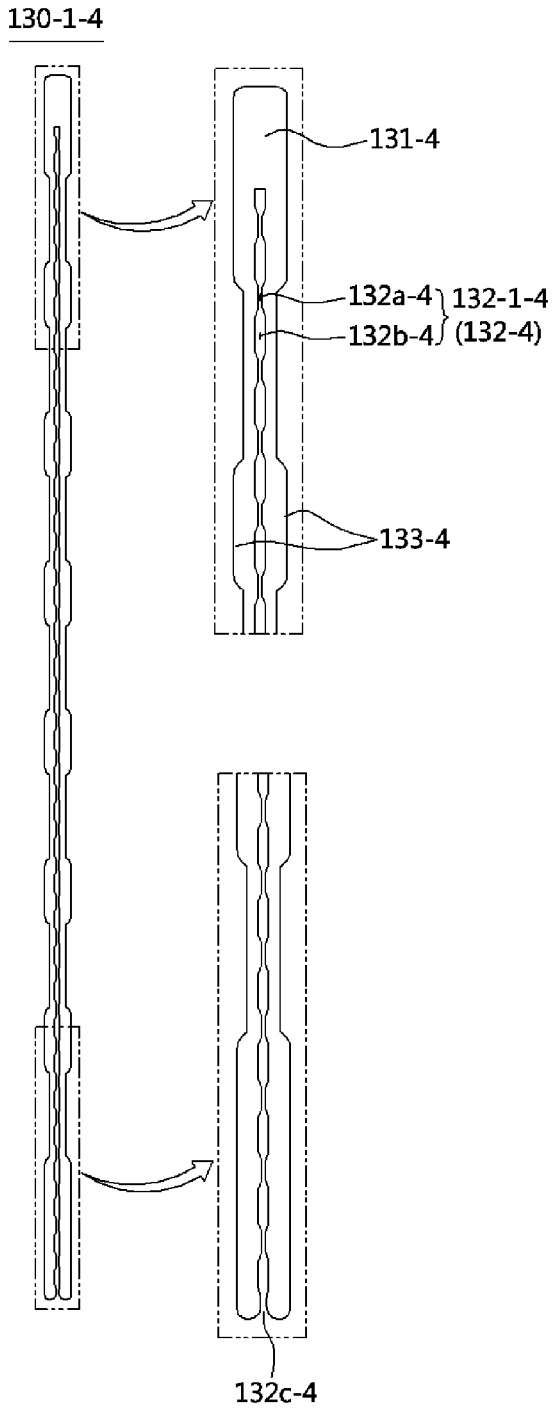

[FIG.39]
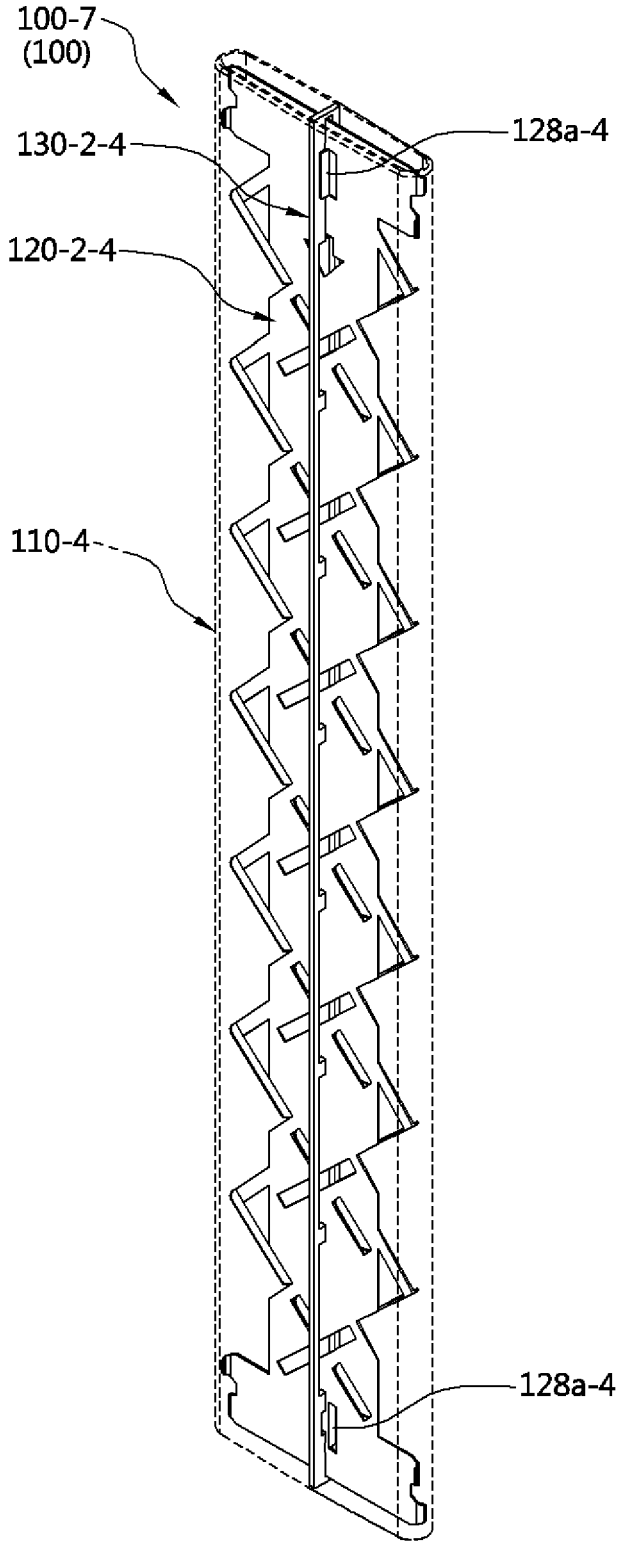

[FIG.40]
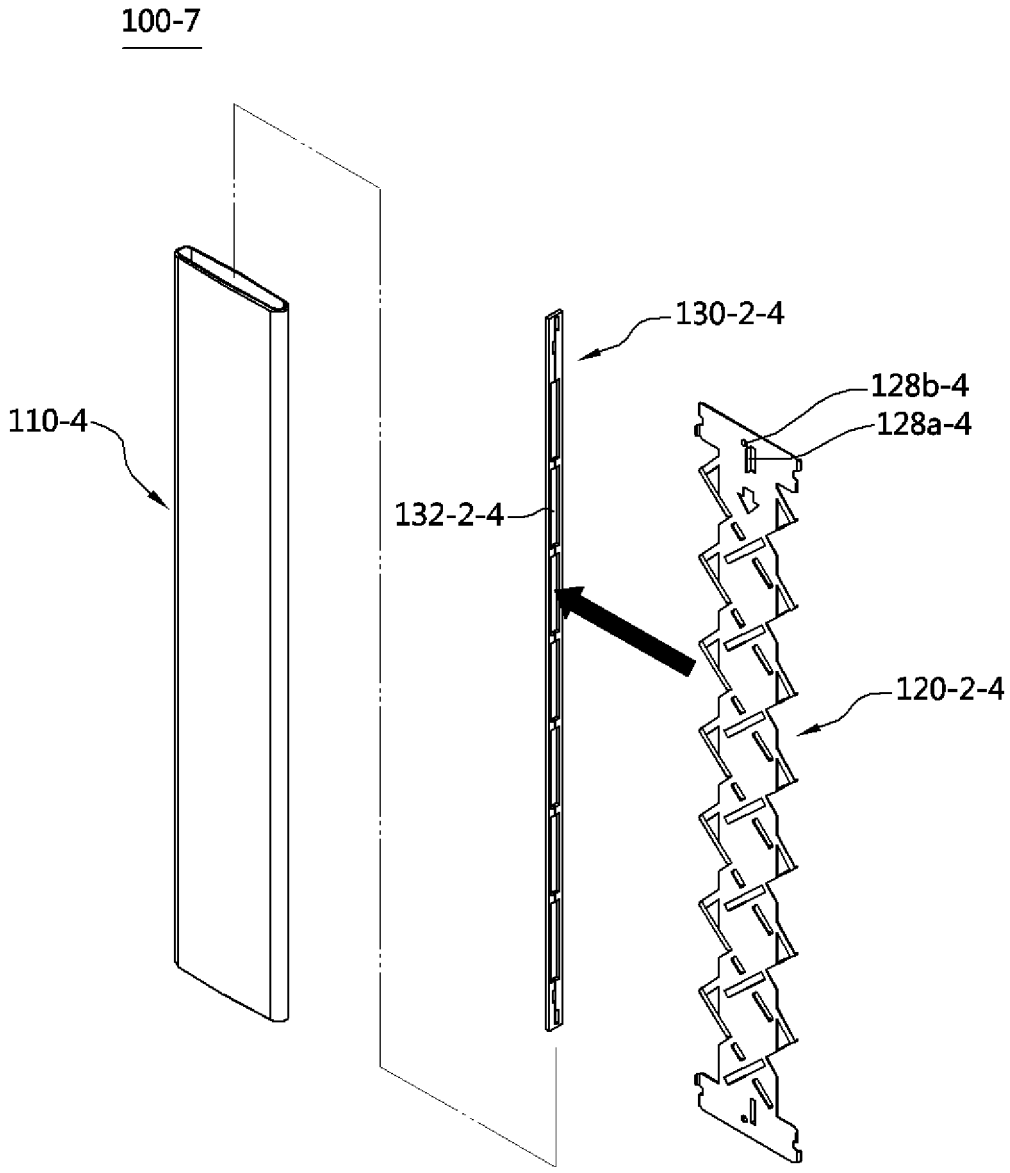

[FIG.41A]
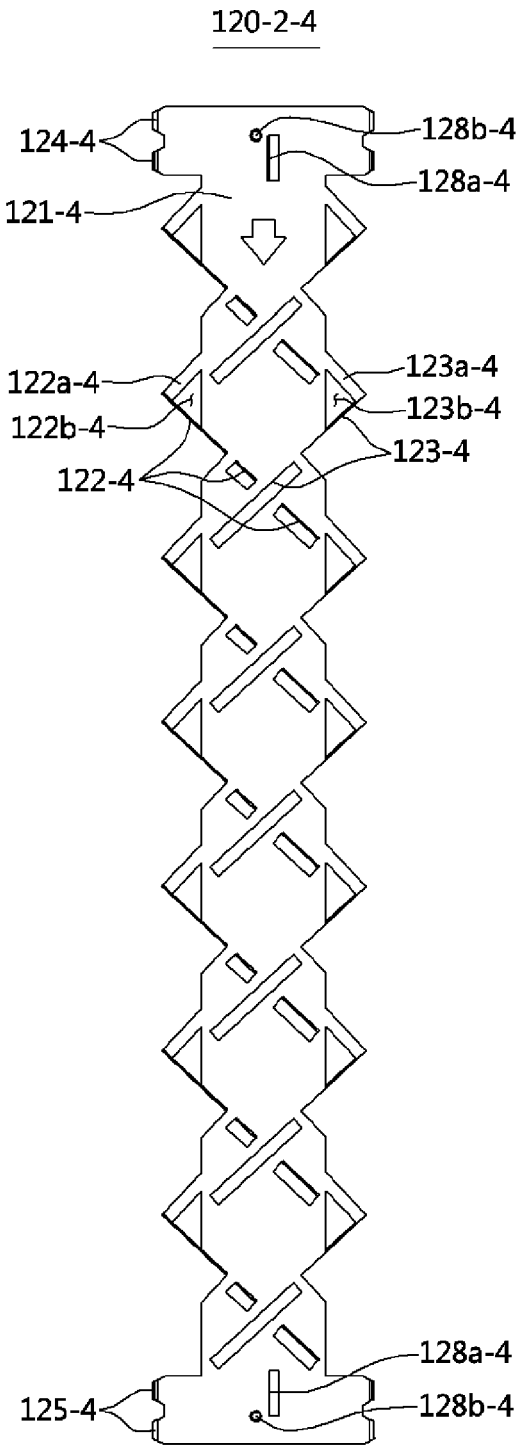

[FIG.41B]
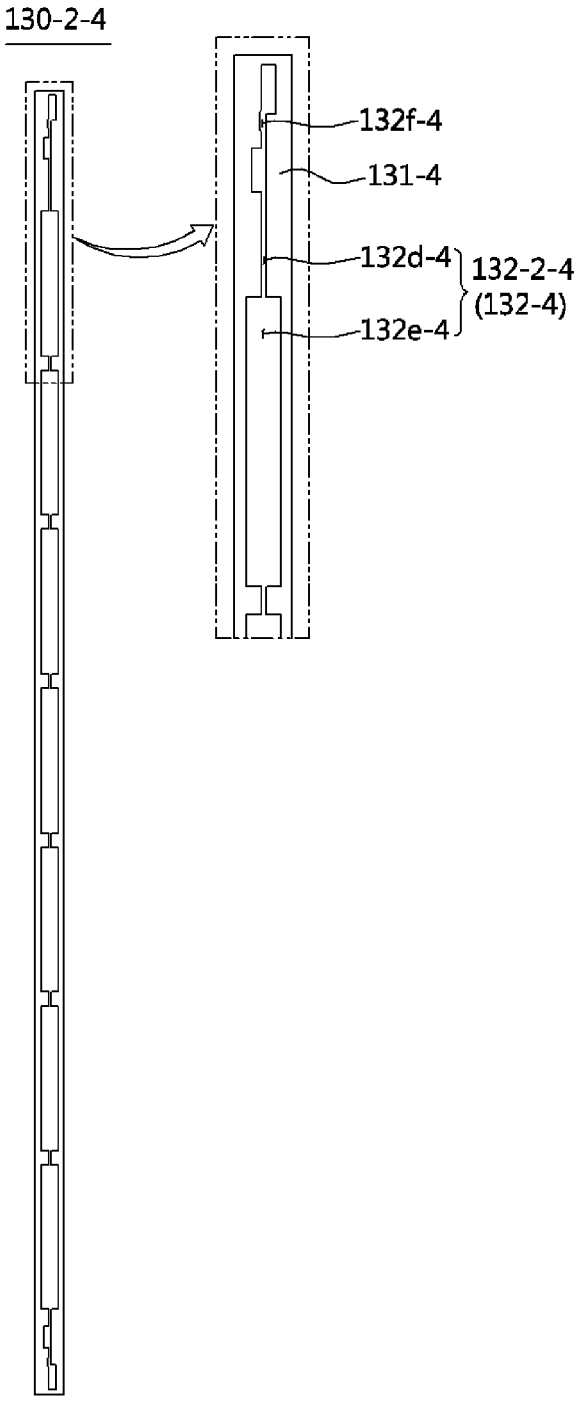

[FIG.42]
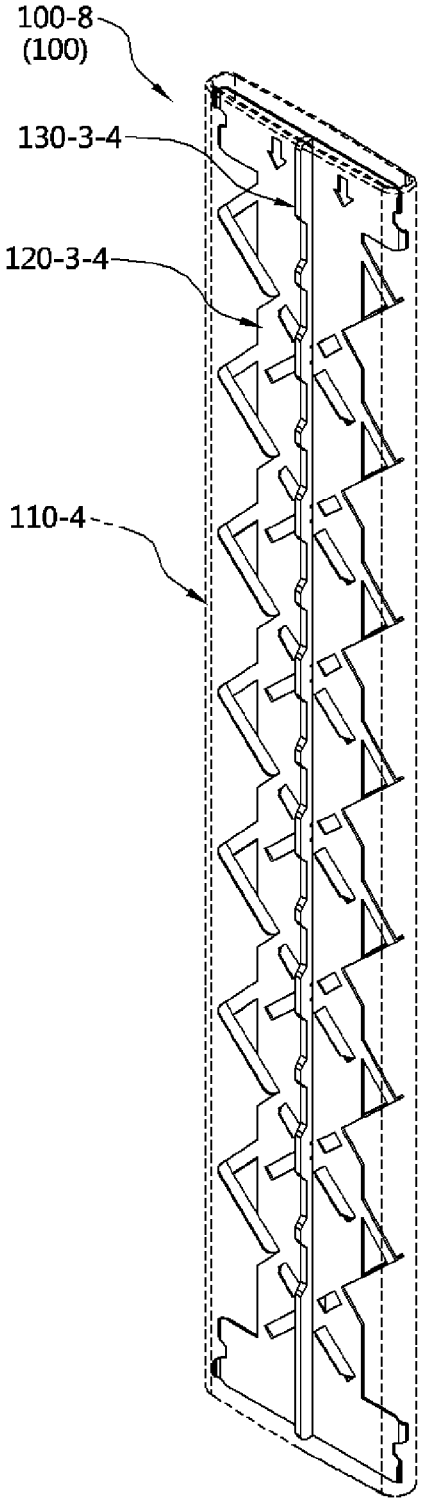

[FIG.43]
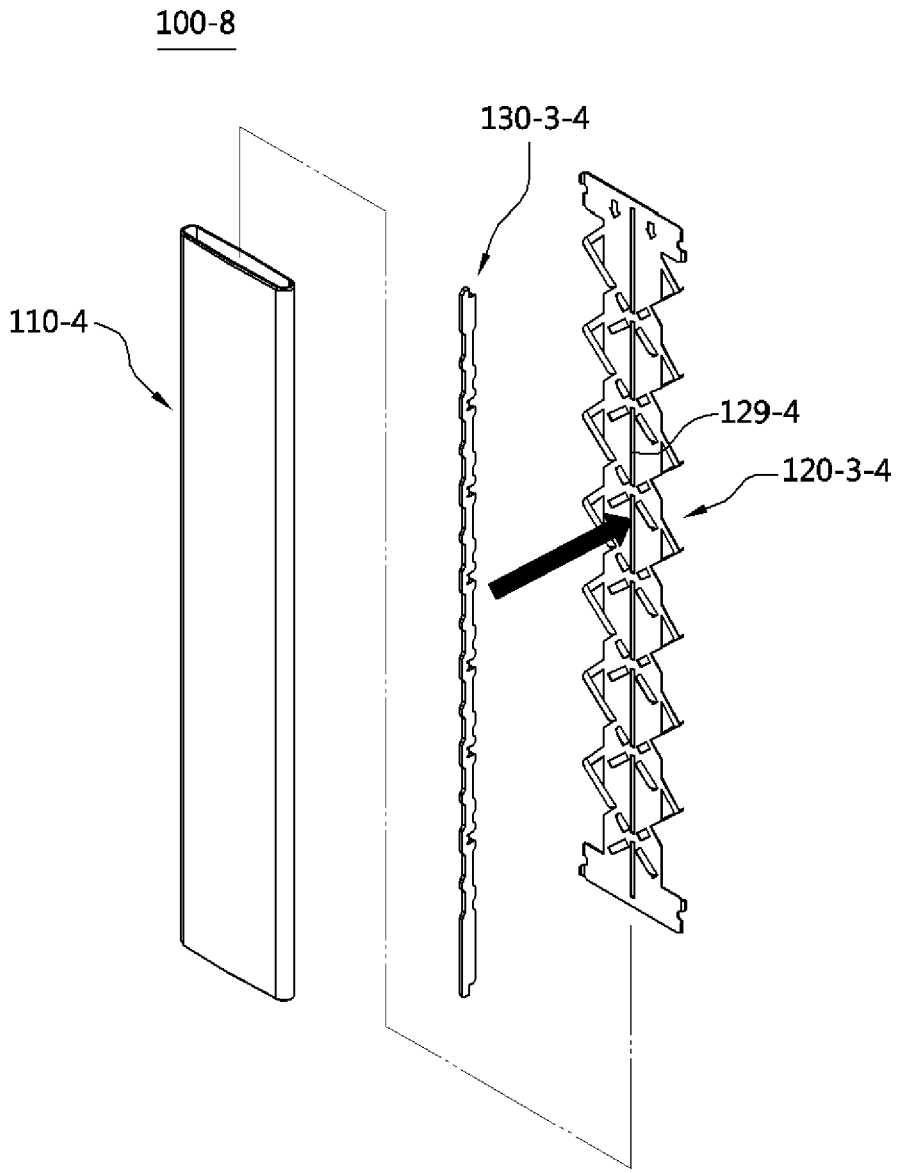

[FIG.44A]
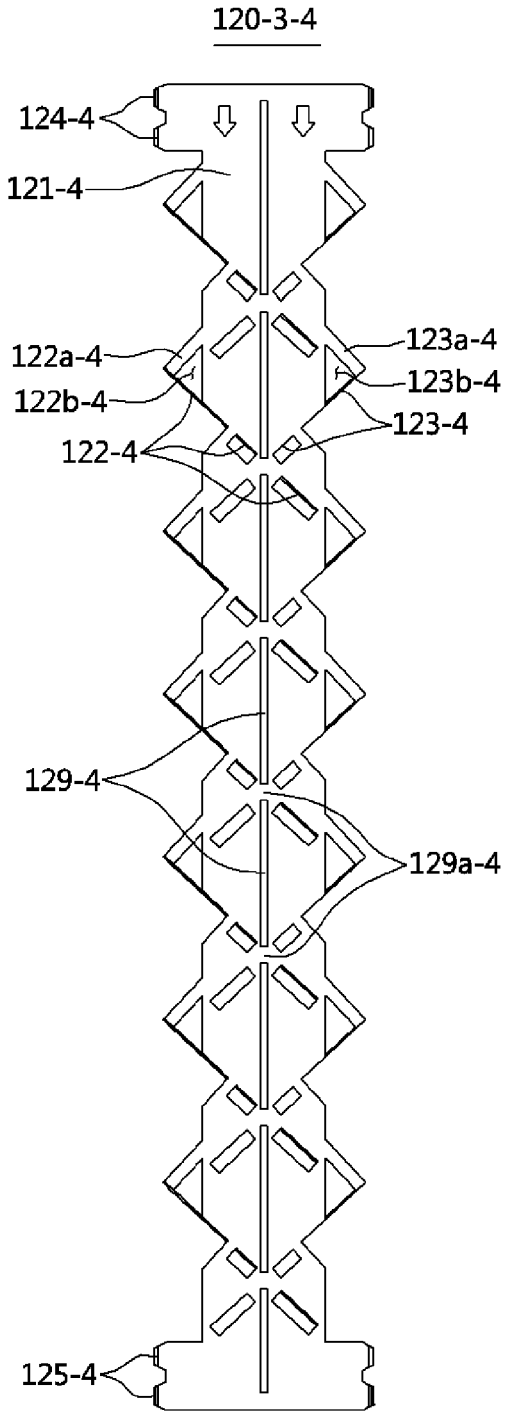

[FIG.44B]
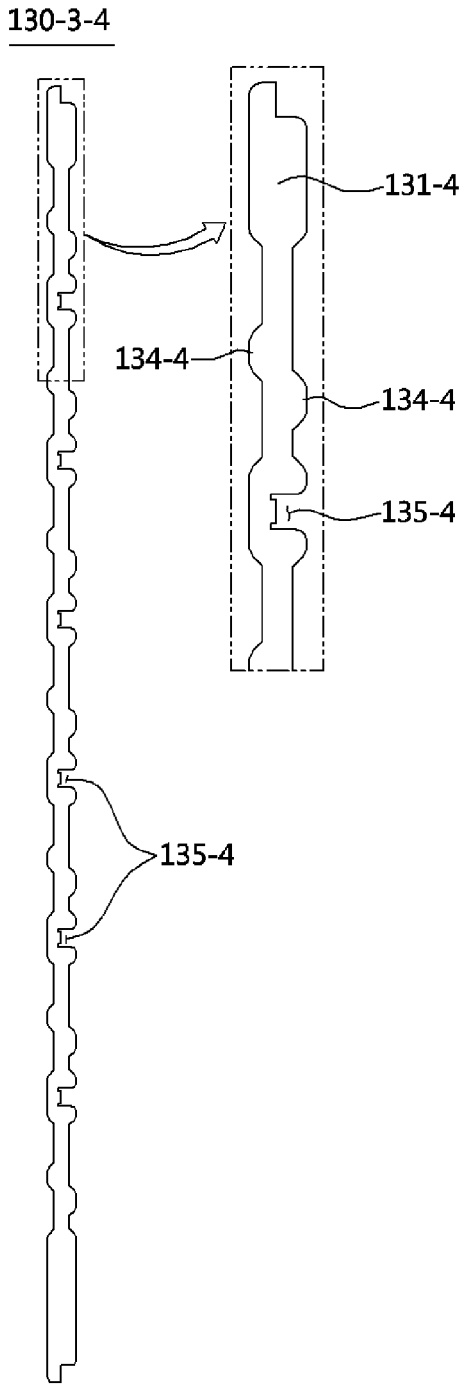

TUBE ASSEMBLY FOR TUBULAR HEAT EXCHANGER, AND TUBULAR HEAT EXCHANGER COMPRISING SAME

CROSS-REFERENCE TO RELATED APPLICATIONS

This application is the U.S. National Phase under 35 U.S.C. § 371 of International Application No. PCT/KR2017/009835 filed on Sep. 7, 2017, which in turn claims the benefit of Korean Applications No. 10-2016-0116363, filed on Sep. 9, 2016, No. 10-2016-0116360, filed on Sep. 9, 2016, and No. 10-2016-0137834, filed Dec. 21, 2016, the disclosures of which are incorporated by reference into the present application.

TECHNICAL FIELD

The present invention relates to a tube assembly for a tubular heat exchanger, and a tubular heat exchanger including the same, and more particularly, to a tube assembly for a tubular heat exchanger capable of increasing efficiency of heat exchange and preventing deformation and damage even in a high-water-pressure environment and a tubular heat exchanger including the same.

BACKGROUND ART

Generally, a heating device includes a heat exchanger in which heat is exchanged between a heat transfer medium and a combustion gas generated by fuel combustion such that heating is performed or hot water is supplied by using the heated heat transfer medium.

Among heat exchangers, a tubular heat exchanger includes a plurality of tubes, in which a combustion gas generated by combustion of a burner flows, and has a structure in which heat is exchanged between the combustion gas and a heat transfer medium by allowing the heat transfer medium to flow outside the tubes.

As a related art of such tubular heat exchangers, FIGS. 1 and 2 illustrate a heat exchanger disclosed in EP Patent Publication No. EP 2508834 and FIGS. 3 and 4 illustrate a heat exchanger disclosed in EP Patent Publication No. EP 2437022.

In the case of the heat exchanger shown in FIGS. 1 and 2, an external jacket has a conical shape in a downward direction based on an upper cover 10 and includes a combustion chamber 4, an upper plate 2, a plurality of smoke tubes below the upper plate, and a lower plate 3 below therebelow. Three types of diaphragms 5, 6, and 7 are installed between the upper plate 2 and the lower plate 3, and an upper diaphragm 5 has a conical shape (angle: $90° < \beta < 180°$) and has an opening portion in a central part thereof. An intermediate diaphragm 6 is a plate smaller than or similar to a diameter of an outer shell, and a lower diaphragm 7 has a diameter similar to that of the outer shell and has a structure with an opening portion in a center thereof. Regular distribution holes are added to the diaphragms and have a structure of being arranged by the number of the holes in single circles or concentric circles.

Heat of a combustion gas generated by combustion of a burner fastened to the upper cover 10 is primarily exchanged in the combustion chamber 4, and sensible heat and latent heat of the combustion gas are transferred to a fluid inside the heat exchanger through the plurality of smoke tubes. The fluid inside the heat exchanger flows in through a fluid inlet 11, passes through a central opening portion of the lower diaphragm 7, flows outside a diameter of the intermediate diaphragm 6, flows through a central opening portion of the upper diaphragm 5, and is discharged through a fluid outlet 12.

The heat exchanger shown in FIGS. 3 and 4 has a structure, which is similar to the structure shown in FIGS. 1 and 2, in which an upper plate 2 and a lower plate 3 have a conical shape.

The smoke tubes having a flat shape and including embossings and applied to the conventional heat exchangers shown in FIGS. 1 to 4 are applicable to low-pressure boilers. However, since a possibility of deformation and damage of the smoke tubes is high when they are used in devices used with high pressure such as water heaters, commercial products, and large-capacity boilers, it is impossible to apply the smoke tubes thereto. To solve this, it is necessary to increase a thickness of an applied material. As a result, material costs are increased greatly.

Also, since an upper part of the smoke tube, through which a high-temperature combustion gas having a large volume per unit mass flows, and a lower part of the smoke tube, through which a low-temperature combustion gas flows after heat exchange, have the same smoke tube structure, when the number of applied embossings is increased to improve efficiency of heat exchange, great flow resistance occurs at the upper part of the smoke tube. To solve this, when the number of applied embossings is decreased, efficiency of heat exchange of a latent heat portion where a condensing effect occurs is greatly decreased.

In the case of a method of increasing the number of embossings in the latent heat portion, it is impossible to manufacture more than a certain number of embossings due to a shape and a size of embossings. Even when the method is applied, a manufacturing process thereof becomes complicated and manufacturing costs are increased.

In the case of the diaphragms therein, due to the conical outer shell, three types have different shapes such that the number of components increases. Particularly, since the upper diaphragm has a conical shape, manufacturing costs thereof increase and an assembling process of the heat exchanger is complicated.

Also, although the flat tubes applied to the conventional heat exchanger are applicable to low-pressure boilers (with a working pressure of 6 $kg/cm^2$ or below), since the possibility of deformation and damage of the smoke tubes is high in devices used with high pressure such as water heaters, commercial products, and large-capacity boilers, it is impossible to apply the smoke tubes thereto. To solve this problem, it is necessary to increase a thickness of an applied material. As a result, heat exchange performance is deteriorated. Also, according to an increase in a level of difficulty in manufacturing, productivity is decreased and manufacturing costs increase.

DISCLOSURE

Technical Problem

The present invention is directed to providing a tube assembly for a tubular heat exchanger capable of increasing efficiency of heat exchange between a heat transfer medium and a combustion gas, and improving durability by preventing high-temperature oxidization and fire damage of a tabulator caused by combustion heat of the combustion gas, and preventing deformation and damage of a tube which may occur in a high-water-pressure environment, and a tubular heat exchanger including the tube assembly.

Technical Solution

One aspect of the present invention provides a tube assembly for a tubular heat exchanger, the tube assembly including a tube having a flat shape to allow a combustion gas generated in a combustion chamber to flow along an inside thereof and to exchange heat between the combustion gas and a heat transfer medium flowing thereoutside and including a turbulator combined with the inside of the tube and inducing turbulence to be generated in a flow of the combustion gas.

The turbulator may include an upper turbulator combined with an upper inside of the tube adjacent to the combustion chamber to come into surface contact with the tube to increase heat conductivity and induce turbulence to be generated in a flow of the combustion gas and include a lower turbulator combined with the inside of the tube below the upper turbulator to induce turbulence to be generated in a flow of the combustion gas.

The upper turbulator may include a first part including a first tube contact surface having a shape corresponding to one side part of the tube and coming into surface contact with an inner surface of the one side part of the tube and include a second part including a second tube contact surface having a shape corresponding to the other side part of the tube and coming into surface contact with an inner surface of the other side part of the tube.

The first portion and the second part of the upper turbulator may be manufactured by bending one basic material plate on the basis of a central line of the basic material plate.

The upper turbulator may include a first pressure support portion formed by cutting and bending a part of the first tube contact surface to allow an outer surface of the second tube contact surface and an outer end thereof to be collinear to support the other side part of the tube and include a second pressure support portion formed by cutting and bending a part of the second tube contact surface to allow an outer surface of the first tube contact surface and an outer end thereof to be collinear to support the one side part of the tube.

The upper turbulator may include a first guide portion formed by cutting and bending a part of the first tube contact surface to face an inner space of the tube and a second guide portion formed by cutting and bending a part of the second tube contact surface to face the inner space of the tube. Here, the first guide portion and the second guide portion may be alternately formed to be vertically spaced apart and induce a flow direction of the combustion gas to change.

The upper turbulator may include a first pressure support portion formed by bending a part of a first cut portion cut from the first tube contact surface and protruding the part toward the second tube contact surface and include a second pressure support portion formed by bending a part of a second cut portion cut from the second tube contact surface and protruding the part toward the first tube contact surface. Here, a protruding end of the first pressure support portion may come into contact with the second tube contact surface, and a protruding end of the second pressure support portion may pass through the first cut portion and come into contact with an inner surface of the tube.

A plurality of such first pressure support portions and a plurality of such second pressure support portions may be provided to be spaced apart laterally and in a vertical direction. Here, the above-located first pressure support portion located on an upper side and the first pressure support portion located on a lower side may be provided in positions which do not overlap with each other in a vertical direction. Also, the above-located second pressure support portion and the below-located second pressure support portion may be provided in positions which do not overlap with each other in a vertical direction.

The first pressure support portion and the second pressure support portion may have a plate shape and may include both large side surfaces arranged in parallel with the flow direction of the combustion gas.

The turbulator may include a plane portion dividing an internal space of the tube and disposed in a longitudinal direction of the tube and may include a plurality of first guide pieces and a plurality of second guide pieces which are spaced apart along a longitudinal direction and alternately protrude from both side surfaces of the plane portion to be inclined.

The first guide pieces may be arranged on one side surface of the plane portion to be inclined toward one side. Here, the second guide pieces may be arranged on the other surface of the plane portion to be inclined toward the other side. Also, a heat transfer medium flowing into the first guide pieces and the second guide pieces may be sequentially transferred to the second guide piece and the first guide piece arranged to be adjacent to an opposite side surface of the plane portion and may alternately flow in both spaces of the plane portion.

A heat transfer medium inlet end of the first guide piece may be connected to one side end of the plane portion by a first connecting piece while a first communication hole, through which a fluid is communicated between the both spaces of the plane portion, may be simultaneously provided between the one side end of the plane portion, the first connecting piece, and the first guide piece. Here, a heat transfer medium inlet end of the second guide piece may be connected to the other side end of the plane portion by a second connecting piece while a second communication hole, through which a fluid is communicated between the both spaces of the plane portion, may be simultaneously provided among the other side end of the plane portion, the second connecting piece, and the second guide piece.

The first guide piece and the second guide piece may be formed by cutting and bending parts of the plane portion toward both sides of the plane portion, and a fluid may be communicated between the both spaces of the plane portion through cut parts of the first guide piece and the second guide piece.

The turbulator may include an upper turbulator provided on an inlet side of the combustion gas and a lower turbulator provided on an outlet side of the combustion gas. Here, vertical distances between a plurality of first guide pieces and a plurality of second guide pieces formed on the lower turbulator may be denser than vertical distances between a plurality of first guide pieces and a plurality of second guide pieces formed on the upper turbulator.

The turbulator may include an upper turbulator provided on an inlet side of the combustion gas and a lower turbulator provided at an outlet side of the combustion gas. Here, a flow path area between the lower turbulator and an inner surface of the tube may be formed to be smaller than a flow path area between the upper turbulator and the inner surface of the tube.

The lower turbulator may have a larger area in contact with the heat transfer medium inside the tube than that of the upper turbulator.

A plurality of protruding portions may be formed on the inner surface of the tube located on the outlet side of the combustion gas.

Supports, which are located to be vertically spaced apart to come into contact with both side surfaces of the tube and protrude back and forth, may be formed at an upper end part and a lower end part of the lower turbulator.

Support pieces, which are located to be vertically spaced apart to come into contact with a front surface and a rear surface of the tube and protrude back and forth, may be formed at an upper end part and a lower end part of the lower turbulator.

The tube assembly may further include a pressure support portion formed inside the tube to support both opposite side surfaces of the tube against external pressure applied thereto.

The pressure support portion may include a plurality of pairs of dimples which protrude from both side surfaces of the tube toward an internal space of the tube and face each other while being vertically spaced apart.

The dimples may be formed by pressurizing an outer surface of the tube toward the inside of the tube after the turbulator is inserted into the tube.

The turbulator may include a plurality of holes to allow the pair of dimples to pass therethrough and come into contact with each other.

The pressure support portion may include supports which protrude outward from the both side surfaces of the turbulator and come into contact with inner surfaces of the tube facing each other.

The supports may be formed by cutting and bending parts of a surface of the turbulator to both sides.

The tube assembly may further include a supporter combined with the turbulator to support the tube against external pressure applied thereto.

A slit having a shape, in which an upper end is blocked and a lower end is opened, may be formed in a central part of the supporter. Here, the turbulator and the supporter may be assembled by inserting the turbulator into an inside of the slit formed in the supporter in a major direction.

A slit having a shape, in which an upper end and a lower end are blocked, may be formed in a surface of the supporter. Here, the turbulator and the supporter may be assembled by inserting the turbulator into an inside of the slit formed in the supporter in a minor direction.

A plurality of slits vertically spaced apart may be formed in a surface of the turbulator. Here, the turbulator and the supporter may be assembled by inserting a part of the supporter into an inside of the slit formed in the turbulator in a vertical direction.

The slit may include a first cut portion having a width which is formed so as to come into contact with both side surfaces of the turbulator and a second cut portion having a width larger than that of the first cut portion, both of which are alternately formed while being vertically connected.

A plurality of pairs of first support pieces and a plurality of pairs of second pieces formed to protrude to support both side surfaces of the supporter may be provided on both side surfaces of the turbulator.

A plurality of protruding portions protruding to come into contact with the inner surface of the tube may be provided while being vertically spaced apart on an outer end of the supporter.

A holding piece and a holding protrusion which protrude to support both side surfaces of the supporter may be formed on an upper end part and a lower end part of the turbulator.

The slit may include a first cut portion having a width which is formed so as to come into contact with both side surfaces of the turbulator and a second cut portion having a width larger than that of the first cut portion, both of which are alternately formed while being vertically connected.

The turbulator may include blocking portions which are each formed between the adjacently located slits, and the supporter may include a plurality of support grooves held by the blocking portions.

A plurality of protruding portions protruding to come into contact with the inner surface of the tube may be provided while being vertically spaced apart on an outer end of the supporter.

Another aspect of the present invention provides a tubular heat exchanger including an external jacket which a heat transfer medium flows into or discharges from, a combustion chamber which is combined with an inside of the external jacket to form a flow path of the heat transfer medium between the external jacket and the combustion chamber and in which combustion of a burner is performed, and the above-described tube assembly for the tubular heat exchanger.

A plurality of such tubes may be vertically installed so as to allow a combustion gas generated in the combustion chamber to flow downward, may be spaced apart in a circumferential direction, and may be radially arranged.

A plurality of such tubes may be additionally arranged in a central part among the plurality of radially arranged tubes.

A multistage diaphragm for guiding a flow of the heat transfer medium to alternately change a flow direction of the heat transfer medium to be inside or outside in a radial direction may be provided to be vertically spaced apart in the external jacket The plurality of tubes may be inserted into and supported by the multistage diaphragms.

The multistage diaphragm may include an upper diaphragm, an intermediate diaphragm, and a lower diaphragm which have a plate shape. Here, the upper diaphragm and the lower diaphragm may include an opening portion for a flow of the heat transfer medium in a central part thereof and an edge part which is formed to come into contact with an inner surface of the external jacket. Also, the intermediate diaphragm may have a shape in which a central part is blocked and an edge part is spaced apart from the inner surface of the external jacket to allow the heat transfer medium to flow therebetween.

An upper tube sheet, into which upper end parts of the plurality of tubes are inserted, may be combined with a lower end of the combustion chamber, and a lower tube sheet, into which lower end parts of the plurality of tubes are inserted, may be combined with a lower end of the external jacket.

The external jacket may have a cylindrical shape.

Advantageous Effects

According to the present invention, a tube includes a turbulator therein such that turbulence may be promoted in a flow of a combustion gas and efficiency of heat exchange may be increased.

Also, an upper turbulator is provided above and pressed against a tube located to be adjacent to a combustion chamber to increase heat conductivity such that high-temperature oxidization and fire damage caused by combustion heat may be prevented. A lower turbulator is provided below the upper turbulator and induces turbulence to be generated in a flow of the combustion gas so as to increase efficiency of heat exchange between the combustion gas and a heat transfer medium.

Also, the upper turbulator includes a pressure support portion and the lower turbulator includes a first support portion, a second support portion, a first support piece, and a second support piece so as to prevent the tube from being deformed and damaged even in a high-water-pressure environment such that the present invention may be expansively applied to a water heater (with a working pressure of 10 $kg/cm^2$ or above), commercial (large capacity) products, and the like other than boilers.

Also, the upper turbulator may include a first part and a second part which are symmetrical to each other. Here, the first part and the second part of the upper turbulator may be formed by bending one basic material plate on the basis of a central line thereof so as to simplify a manufacturing process of the upper plate.

Also, an area of a combustion gas flow path between the tube and the turbulator provided at a latent heat exchanger is smaller than an area of a combustion gas flow path between the tube and the turbulator provided at a sensible heat exchanger such that flow resistance of the combustion gas may be reduced at the sensible heat exchanger, into which the combustion gas flows, and recovery efficiency of latent heat may be increased at the latent heat exchanger so as to increase efficiency of heat exchange.

Also, the sensible heat exchanger and the latent heat exchanger are formed in an integral structure such that a structure of a heat exchanger may be simplified and a welding part between components may be reduced. A miniaturized high efficiency heat exchanger may be embodied by forming a flat tube.

Also, since the turbulator and the supporter fit in a major direction, a minor direction, or a vertical direction and then are inserted into and assembled in the tube, an assembling structure of a tube assembly may be simplified.

Also, an uneven-shaped protruding portion is formed on an outer surface of the supporter to reduce a contact area between the support and the tube such that occurrence of crevice corrosion caused by congestion of the heat transfer medium when a contact area between the supporter and the tube is large may be prevented so as to increase durability of the tube assembly.

Also, a flow direction of the heat transfer medium is converted by arranging multistage diaphragms on a flow path of the heat transfer medium such that the flow path of the heat transfer medium is lengthened to increase efficiency of heat exchange and increase a flow speed of the heat transfer medium. Accordingly, it is possible to prevent local overheating which may occur when the heat transfer medium is congested so as to prevent boiling noise occurrence and deterioration of heat efficiency caused by solidification and deposition of foreign substances included in the heat transfer medium due to the congestion of the heat transfer medium.

DESCRIPTION OF DRAWINGS

FIG. 1 is a cross-sectional perspective view illustrating one example of a conventional tubular heat exchanger, FIG. 2 is a cross-sectional view of FIG. 1, FIG. 3 is a perspective cross-sectional view illustrating another example of a conventional tubular heat exchanger, FIG. 4 is a cross-sectional view of FIG. 3, FIG. 5 is an external perspective view of a tubular heat exchanger according to the present invention, FIG. 6 and FIG. 7 are exploded perspective views of the tubular heat exchanger according to the present invention, FIG. 8 is a plan view of FIG. 5, FIG. 9 is a perspective cross-sectional view taken along a line A-A in FIG. 8, FIG. 10 is a cross-sectional view taken along the line A-A in FIG. 8, FIG. 11 is a transparent perspective view of a tube assembly for a tubular heat exchanger according to a first embodiment of the present invention, FIG. 12 is a plan view of FIG. 11, FIG. 13 is an exploded perspective view illustrating a process of assembling the tube assembly for the tubular heat exchanger according to the first embodiment of the present invention, FIG. 14 is a front view illustrating an upper turbulator and a lower turbulator according to the first embodiment of the present invention, FIGS. 15A and 15B are a cross-sectional view and a perspective cross-sectional view taken along a line B-B of FIG. 14, respectively, FIGS. 16A and 16B are side views illustrating a manufacturing process of embodying a shape of the upper turbulator according to the first embodiment of the present invention, FIG. 17 is a front view illustrating the manufacturing process of embodying the shape of the upper turbulator according to the first embodiment of the present invention, FIG. 18 is a perspective view of an upper turbulator of a tube assembly for a tubular heat exchanger according to a second embodiment of the present invention, FIG. 19 is a plan view of FIG. 18, FIGS. 20A and 20B are a cross-sectional view and a perspective cross-sectional view taken along a line B-B of FIG. 19, respectively, FIG. 21 is a left side view of FIG. 18, FIG. 22 is an external perspective view of a tube assembly for a tubular heat exchanger according to a third embodiment of the present invention, FIG. 23 is a transparent perspective view of a tube assembly for a tubular heat exchanger according to the third embodiment of the present invention, FIG. 24 is an exploded perspective view illustrating a process of assembling and processing the tube assembly for the tubular heat exchanger according to the third embodiment of the present invention, FIG. 25 is a front view illustrating a turbulator according to the third embodiment of the present invention, FIG. 26A is a front view of the tube assembly for the tubular heat exchanger according to the third embodiment of the present invention, and FIG. 26B is a cross-sectional view taken along a line E-E, FIG. 27 is a transparent perspective view of a tube assembly for a tubular heat exchanger according to a fourth embodiment of the present invention, FIG. 28 is an exploded perspective view illustrating a process of assembling the tube assembly for the tubular heat exchanger according to the fourth embodiment of the present invention, FIG. 29 is a front view illustrating a turbulator according to the fourth embodiment of the present invention, FIG. 30 is a plan view of FIG. 27;

FIG. 31 is an exploded perspective view illustrating a process of assembling a tube assembly for a tubular heat exchanger according to a fifth embodiment of the present invention, FIG. 32A is a front view of the turbulator shown in FIG. 31, and FIG. 32B is a perspective view illustrating a flow of a combustion gas, FIG. 33 is a cross-sectional view illustrating a tubular shape of an outlet side of a combustion gas of the tube assembly for the tubular heat exchanger according to the fifth embodiment of the present invention, FIG. 34A, FIG. 34B, FIG. 34C and FIG. 34D are cross-sectional views illustrating a variety of examples of a supporting structure of a tube, FIG. 35 is a transparent perspective view of a tube assembly for a tubular heat exchanger according to a sixth embodiment of the present invention, FIG. 36 is a plan view of FIG. 35, FIG. 37 is an exploded perspective view illustrating a process of assembling the tube assembly for the tubular heat exchanger according to the sixth embodiment of the present invention, FIG. 38A is a front view of a turbulator according to the sixth embodiment of the present invention, and FIG. 38B is a side view of a support, FIG. 39 is a transparent perspective view of a tube assembly for a tubular heat exchanger according to a seventh embodiment of the present invention, FIG. 40 is an exploded perspective view illustrating a process of assembling the tube assembly for the tubular heat exchanger according to the seventh embodiment of the present invention, FIG. 41A is a front view of a turbulator according to the seventh embodiment of the present invention, and FIG. 41B is a side view of a support, FIG. 42 is a transparent perspective view of a tube assembly for a tubular heat exchanger according to an eighth embodiment of the present invention, FIG. 43 is an exploded perspective view illustrating a process of assembling the tube assembly for the tubular heat exchanger according to the eighth embodiment of the present invention, and FIG. 44A is a front view of a turbulator according to the eighth embodiment of the present invention, and FIG. 44B is a side view of a support.

Description of Reference Numerals

| | |
|---|---|
| 1000: tubular heat exchanger | 1000a: sensible heat exchanging portion |
| 1000b: latent heat exchanging portion | 1100: external jacket |
| 1110: heat transfer medium inlet | 1120: heat transfer medium outlet |
| 1200: combustion chamber | 1300: upper tube sheet |
| 1600: upper diaphragm | 1700: intermediate diaphragm |
| 1800: lower diaphragm | 1900: lower tube sheet |
| 100: tube assembly | 110: tube |
| 120: turbulator | 120-1: upper turbulator |
| 130-1: lower turbulator | 122-1, 125-1: pressure-support portions |
| 123-1: guide portion | 130-1-1 to 130-1-4: supporters |

MODES OF THE INVENTION

Hereinafter, components and operations according to an exemplary embodiment of the present invention will be described in detail as follows with reference to the attached drawings.

Referring to FIGS. 5 to 10, a tubular heat exchanger 1000 according to the present invention includes an external jacket 1100 where a heat transfer medium flows in and is discharged from, a combustion chamber 1200 combined with an inside of the external jacket 1100 to form a flow path of the heat transfer medium therebetween and in which combustion of a burner is performed, and a tube assembly 100 which includes a plurality of tubes having a flat shape to allow a combustion gas generated in the combustion chamber 1200 to flow therein to exchange heat with the heat transfer medium and includes turbulators combined with insides of the tubes, inducing turbulence to occur in the flow of the combustion gas and supporting the tubes. Components and operations of a variety of examples 100-1 to 100-8 of the tube assembly 100 including the tubes and turbulators will be described below.

Also, an upper tube sheet 1300 into which upper ends of the plurality of tubes are inserted is combined with a lower end of the combustion chamber 1200. A plurality of multistage diaphragms 1600, 1700, and 1800 for guiding a flow of the heat transfer medium to alternately switch a flow direction of the heat transfer medium to be inside or outside a radial direction are provided on outer surfaces of the tubes 1400 to be vertically spaced apart. A lower tube sheet 1900 into which lower ends of the plurality of tubes are inserted is combined with a lower end of the external jacket 1100.

The plurality of tubes are installed in a vertical direction such that a combustion gas generated in the combustion chamber 1200 flows downward and installed while being spaced apart in a circumferential direction and radially arranged. A plurality of tubes may be additionally arranged in a central part among the plurality of radially arranged tubes.

The external jacket 1100 has a cylindrical shape having open upper and lower parts. A heat transfer medium inlet 1110 is connected to one side of the lower part, and a heat transfer medium outlet 1120 is connected to one side of the upper part. The external jacket 1100 is configured to have a cylindrical shape so as to increase internal pressure performance.

The combustion chamber 1200 includes a cylindrical combustion chamber body 1210 having open upper and lower parts and a flange portion 1220 formed on an upper end of the combustion chamber body 1210 and mounted on an upper end of the external jacket 1100. The combustion chamber body 1210 is disposed to be spaced apart inward from an inner surface of the external jacket 1100 such that a space S4 having a blister structure through which the heat transfer medium flows is provided between the combustion chamber body 1210 and the external jacket 1100.

Referring to FIG. 7, the upper tube sheet 1300 seals up a lower part of the combustion chamber 1200 and includes a plurality of tube insertion holes 1310 and 1320 where the upper and lower parts of the tubes 1400 are inserted into and combined with.

The multistage diaphragms 1600, 1700, and 1800 are combined with the outer surfaces of the tubes while being vertically spaced apart therefrom so as to switch the flow of the heat transfer medium and support the tubes.

The multistage diaphragms 1600, 1700, and 1800 may include an upper diaphragm 1600, an intermediate diaphragm 1700, and a lower diaphragm 1800 which have a plate shape.

Tube insertion holes 1610 are radially formed in the upper diaphragm 1600. An opening portion 1620 through which the tubes 1400 pass and the heat transfer medium flows is formed in a central part of the upper diaphragm 1600. An edge part of the upper diaphragm 1600 comes into contact with the inner surface of the external jacket 1100.

A plurality of tube insertion holes 1710 and 1720 are formed in the intermediate diaphragm 1700. An area where the tube insertion holes 1710 and 1720 are not formed has a closed shape. An edge part of the intermediate diaphragm 1700 is spaced apart from the inner surface of the external jacket 1100 such that a flow path of the heat transfer medium is provided therebetween.

The lower diaphragm 1800 has the same structure as that of the upper diaphragm 1600. Tube insertion holes 1810 are radially formed therein. An opening portion 1820 through which the tubes pass and the heat transfer medium flows is formed in a central part of the lower diaphragm 1800. An edge part of the lower diaphragm 1800 comes into contact with the inner surface of the external jacket 1100.

The lower tube sheet 1700 seals the lower part of the external jacket 1100 and includes a plurality of tube insertion holes 1910 and 1920 into which lower ends of the tubes are inserted.

Referring to FIGS. 9 and 10, the tubular heat exchanger 1000 according to the present invention includes a sensible heat exchanger 1000*a*, in which heat is exchanged between combustion sensible heat generated in the combustion chamber 1200 and the heat transfer medium, and a latent heat exchanger 1000*b*, in which heat is exchanged between latent heat of a combustion gas which have passed through the sensible heat exchanger 1000*a* and the heat transfer medium. The sensible heat exchanger 1000*a* and the latent heat exchanger 1000*b* are integrally formed.

The combustion gas generated in the combustion chamber 1200 flows downward along an internal space of the tubes.

As an arrow shows in FIG. 10, the heat transfer medium flowing into a first space 51 in the external jacket 1100 through the heat transfer medium inlet 1110 passes between the plurality of tubes, passes through the opening portion 1820 formed in the lower diaphragm 1800, and flows toward a central part of a second space S2 provided thereabove. The heat transfer medium, which has flowed outward from the second space S2, passes through a space G between the intermediate diaphragm 1700 and the external jacket 1100 and flows toward a space S3 provided thereabove. The heat transfer medium, which has flowed inward from the third space S3, passes through the opening portion 1620 formed in the center of the upper diaphragm 1600, passes the fourth space S4 provided between the combustion chamber body 1210 and the external jacket 1100, and then is discharged through the heat transfer medium outlet 1120.

As the flow direction of the heat transfer medium is alternately switched inside or outside the radial direction, the flow path of the heat transfer medium increases such that efficiency of heat exchange increases and a flow speed of the heat transfer medium increases so as to prevent a boiling phenomenon caused by local overheating which may occur when the heat transfer medium stagnates.

Hereinafter, embodiments of the tube assembly 100 for the tubular heat exchanger according to the present invention will be described.

First Embodiment

Referring to FIGS. 11 to 17, a tube assembly 100-1 for a tubular heat exchanger according to a first embodiment of the present invention includes a tube 110-1 having a flat shape to exchange heat between a combustion gas generated in a combustion chamber and flowing along an inside thereof and a heat transfer medium flowing thereoutside, an upper turbulator 120-1 combined with an upper inside of the tube 110-1 adjacent to the combustion chamber to come into surface-contact with the tube 110-1 so as to increase heat conductivity and to induce turbulence to be generated in a flow of the combustion gas, and a lower turbulator 130-1 combined with the inside of the tube 110-1 below the upper turbulator 120-1 and inducing turbulence to be generated in the flow of the combustion gas.

The upper turbulator 120-1 includes tube contact surfaces 121-1 (121*a*-1 and 121*b*-1) coming into close contact with an inner surface of the tube 110-1, pressure support portions 122-1 (122*a*-1 and 122*b*-1) formed by bending parts cut from the tube contact surfaces 121-1 (121*a*-1 and 121*b*-1), and guide portions 123-1 (123*a*-1 and 123*b*-1).

The tube contact surfaces 121-1 have a structure in which a first tube contact surface 121*a*-1, which comes into surface contact with an inner surface of one side part of the tube 110-1, is symmetrical to a second tube contact surface 121*b*-1 which comes into surface contact with an inner surface of the other side part of the tube 110-1.

The pressure support portions 122-1 includes a first pressure support portion 122*a*-1 which is formed by cutting and bending a part of the first tube contact surface 121*a*-1 such that an outer surface of the second tube contact surface 121*b*-1 and an outer end of the part are collinear so as to support the other part of the tube 110-1 and includes a second pressure support portion 122*b*-1 which is formed by cutting and bending a part of the second tube contact surface 121*b*-1 such that an outer surface of the first tube contact surface 121*a*-1 and the part are collinear so as to support one part of the tube 110-1, both of which are components for preventing the tube 110-1 from being deformed and damaged by water pressure of the heat transfer medium.

The guide portions 123-1 includes a first guide portion 123*a*-1 formed by cutting and bending a part of the first tube contact surface 121*a*-1 to face an inner space of the tube 100-1 and includes a second guide portion 123*b*-1 formed by cutting and bending a part of the second tube contact surface 121*b*-1 to face the inner space of the tube 100-1, both of which are components for increasing efficiency of heat exchange by changing a flow direction of a combustion gas passing through the upper turbulator 120-1.

The first guide portion 123*a*-1 and the second guide portion 123*b*-1 are alternately formed while being vertically spaced apart. Accordingly, the combustion gas flows leftward or rightward on the basis of a vertical direction as an arrow shown in FIG. 15A.

Referring to FIGS. 16 and 17, the upper turbulator 120-1 is manufactured by bending one basic material plate on the basis of a central line C thereof into a first part 120*a*-1 located on one side and a second part 120*b*-1 located on the other side.

First, the first tube contact surface 121*a*-1, the first pressure support portion 122*a*-1, and the first guide portion 123*a*-1 are manufactured at the first part 120*a*-1 of the basic material plate, and the second tube contact surface 121*b*-1, the second pressure support portion 122*b*-1, and the second guide portion 123*b*-1 are manufactured at the second part 120*b*-1 of the basic material plate. Also, the upper turbulator 120-1 is manufactured by bending the first part 120*a*-1 and the second part 120*b*-1 on the basis of the central line C in a direction of an arrow shown in FIG. 16B. According to such components, the first part 120*a*-1 and the second part 120*b*-1 formed to be symmetrical to each other are bent on the basis of the central line C so as to simplify a manufacturing process for embodying the upper turbulator 120-1.

According to the components of the upper turbulator 120-1, the tube contact surfaces 121-1 of the upper turbulator 120-1 are pressed against the inner surface of the tube 110-1 so as to increase heat conductivity between the upper turbulator 120-1 and the tube 110-1. Accordingly, even when the combustion gas comes into direct contact with the upper turbulator 120-1, since combustion heat of the combustion gas transferred to the upper turbulator 120-1 is easily transferred toward the tubes through heat conduction, it is possible to prevent the upper turbulator 120-1 from being overheated, thereby effectively preventing the upper turbulator 120-1 from being oxidized at a high temperature and being damaged by a fire.

Hereinafter, components and an operation of the lower turbulator 130-1 will be described.

The lower turbulator 130-1 may include a plane portion 131-1 disposed in a longitudinal direction of the tube 110-1 while dividing an internal space of the tube 110-1 into both sides and include a first guide piece 132-1 and a second guide piece 133-1 alternately protruding from both sides of the plane portion 131-1 to be inclined while being spaced apart along the longitudinal direction.

The first guide piece 132-1 is disposed on one side surface of the plane portion 131-1 to be inclined toward one side, and the second guide piece 133-1 is disposed on the other side surface of the plane portion 131-1 to be inclined toward the other side. Accordingly, the heat transfer medium, which has flowed into the first guide piece 132-1 and the second guide piece 133-1, is sequentially transferred to the second guide piece 133-1 and the first guide piece 132-1 adjacently arranged on opposite sides of the plane portion 131-1 and alternately flows through both spaces of the plane portion 131-1.

A heat transfer medium inlet end of the first guide piece 132-1 is connected to one side end of the plane portion 131-1 by a first connecting piece 132*a*-1 while a first communication hole 132*b*, through which fluid is communicated between both spaces of the plane portion 131-1, is simultaneously provided among the one side end of the plane portion 131-1, the first connecting piece 132*a*-1, and the first guide piece 132-1.

A heat transfer medium inlet end of the second guide piece 133-1 is connected to the other side end of the plane portion 131-1 by a second connecting piece 133*a*-1 while simultaneously a second communication hole 133*b*-1, through which fluid is communicated between both spaces of the plane portion 131-1, is provided among the other side end of the plane portion 133, the second connecting piece 133*a*, and the second guide piece 133.

The first guide piece 132-1 and the second guide piece 133-1 may be formed by cutting and bending parts of the plane portion 131-1 to both sides of the plane portion 131-1 to communicate a fluid between both spaces of the plane portion 131-1 through the cut portions of the plane portion 131-1.

Also, a first support portion 134-1 and a second support portion 135-1, which are located to be vertically spaced apart and protrude back and forth to come into contact with both sides of the tube 110-1, are formed on an upper end part and a lower end part of the lower turbulator 130-1, respectively.

Also, first support pieces 136-1 (136*a*-1 and 136*b*-1) and second support pieces 137-1 (137*a*-1 and 137*b*-1), which are located to be vertically spaced apart and protrude back and forth to come into contact with a front surface and a rear surface of the tube 110-1, are formed on the upper end part and the lower end part of the lower turbulator 130-1.

Since the lower turbulator 130-1 includes the first support portion 134-1, the second support portion 135-1, the first support pieces 136-1, and the second support pieces 137-1, it is possible to prevent a tube from being deformed or damaged even in an environment with high water pressure such that the tube may be extensively applied to water heaters with a working pressure of 10 kg/cm$^2$ or above, commercial (large capacity) products, and the like other than boilers.

Second Embodiment

Referring to FIGS. 18 to 21, a tube assembly 100-2 for a tubular heat exchanger according to a second embodiment of the present invention is formed by changing components of the upper turbulator of the tube assembly 100-1 for the tubular heat exchanger according to the first embodiment of the present invention, in which the tube 110-1 and the lower turbulator 130-1 may have the same structure.

In the embodiment, an upper turbulator 120-1-1 includes tube contact surfaces 124-1 (124*a*-1 and 124*b*-1) coming into close contact with an inner surface of the tube 100-1 and pressure support portions 125-1 (125*a*-1 and 125*b*-1) formed by being bent from cut portions 126-1 (126*a*-1 and 126*b*-1) of the tube contact surfaces 124-1 (124*a*-1 and 124*b*-1).

The tube contact surfaces 124-1 have a structure in which a first tube contact surface 124*a*-1, which comes into surface contact with an inner surface of one side part of the tube 110-1, is symmetrical to a second tube contact surface 124*b*-1 which comes into surface contact with an inner surface of the other side part of the tube 110-1.

The pressure support portions 125-1 are components for preventing the tube 110-1 from being deformed and damaged by water pressure of a heat transfer medium and includes a first pressure support portion 125*a*-1 formed by bending a part of a first cut portion 126*a*-1 of the first tube contact surface 124*a*-1 to protrude toward the second tube contact surface 124*b*-1 and includes a second pressure support portion 125*b*-1 formed by bending a part of a second cut portion 126*b*-1 of the second tube contact surface 124*b*-1 to protrude toward the first tube contact surface 124*a*-1.

A cut area of the first cut portion 126*a*-1 is formed to be larger than a cut area of the second cut portion 126*b*-1. A protruding end of the first pressure support portion 125*a*-1 comes into contact with the second tube contact surface 124*b*-1. When the pressure support portion 125-1 is inserted into the tube 110-1, a protruding end of the second pressure support portion 125*b*-1 passes through the first cut portion 126*a*-1 and comes into contact with the inner surface of the tube 110-1.

According to the components, the first pressure support portion 125*a*-1 supports the first tube contact surface 124*a*-1 and the second tube contact surface 124*b*-1 to maintain shapes thereof firmly when water pressure acts, and the second pressure support portion 125*b*-1 more firmly supports the tube 110-1 supported by the first tube contact surface 124*a*-1 and the second tube contact surface 124*b*-1.

Also, as shown in FIG. 21, pluralities of such first pressure support portions 125*a*-1 and such second pressure support portions 125*b*-1 are provided while being spaced apart back and forth and in a vertical direction. A first pressure support portion 125*a*'-1 located above, and a first pressure support portion 125*a*"-1 located below, are provided in positions not overlapped with each other in a vertical direction. A second pressure support portion 125*b*'-1 located above and a second pressure support portion 125*b*"-1 located below are also provided in positions not overlapped with each other. According to the components, since water pressure applied to the tube 110-1 is uniformly dispersed by the first pressure support portions 125*a*-1 and the second pressure support portions 125*b*-1 provided over the entire area of the upper turbulator 120-1-1 while having a zigzag shape back and forth and in the vertical direction, it is possible to effectively prevent the tube 110-1 from being deformed and damaged.

Also, since the first pressure support portion 125*a*-1 and the second pressure support portion 125*b*-1 have a structure in which both large side surfaces having a plate shape are arranged to be in parallel with a flow direction of a combustion gas, it is possible to minimize flow resistance during a process in which the combustion gas passes through the first pressure support portion 125*a*-1 and the second pressure support portion 125*b*-1 when the combustion gas flows as an arrow shown in FIG. 20A.

The tube assembly 100-2 according to the embodiment, like the above-described first embodiment, may be manufactured by bending one basic material plate on the basis of a central line C thereof into a first part 120*a*-1 located on one side and a second part 120*b*-1 located on the other side.

Third Embodiment

Referring to FIGS. 22 to 26, a tube assembly 100-3 for a tubular heat exchanger according to a third embodiment of the present invention includes a tube 110-2 having a flat shape for exchanging heat between a combustion gas flowing along an inside thereof and a heat transfer medium flowing outside, a turbulator 120-1-2 combined with the inside of the tube 110-2 to induce turbulence to be generated in a flow of the combustion gas, and a pressure support portion formed inside the tube 110-2 for supporting both opposite sides of the tube 110-2 against external pressure applied thereto.

The pressure support portion includes a pair of dimples 111-2 (111*a*-2 and 111*b*-2) which protrude from both side surfaces of the tube 110-2 toward an internal space of the tube 110-2 and face each other while being vertically spaced apart. A plurality of such pairs of dimples 111-2 are formed.

Referring to FIGS. 24 and 26, the dimples 111-2 (111*a*-2 and 111*b*-2) are formed by a process of pressurizing an outer surface of the tube 110-2 toward the inside of the tube 110-2 as an arrow shown in FIG. 24 after the turbulator 120-1-2 is inserted into the tube 110-2. Also, a plurality of holes 128-2, which allow the pair of dimples 111-2 (111*a*-2 and 111*b*-2) to pass therethrough and come into contact with each other when external pressure increases, are formed in the turbulator 120-1-2.

Since the pressure support portion are embodied by forming the dimples 111-2 (111*a*-2 and 111*b*-2) on an outer surface of the tube 110-2 in which the turbulator 120-1-2 is inserted such that it is possible to embody the pressure support portion without an additional component, manufacturing costs of a tube assembly having excellent pressure-resistant performance may be reduced.

Referring to FIG. 25, the lower turbulator 120-1-2 may include a plane portion 121-2 disposed in a longitudinal direction of the tube 110-2 while dividing an internal space of the tube 110-2 into both sides and include first guide pieces 122-2 and second guide pieces 123-2 alternately protruding from both sides of the plane portion 121-2 to be inclined while being spaced apart along the longitudinal direction.

The first guide pieces 122-2 are arranged on one side surface of the plane portion 121-2 to be inclined toward one side, and the second guide pieces 123-2 are arranged on the other side surface of the plane portion 121-2 to be inclined toward the other side. Accordingly, the heat transfer medium, which has flowed into the first guide pieces 122-2 and the second guide pieces 123-2, is sequentially transferred to the second guide pieces 123-2 and the first guide pieces 121-2 adjacently arranged on opposite sides of the plane portion 121-2 and alternately flows through both spaces of the plane portion 121-2.

A heat transfer medium inlet end of the first guide piece 122-2 is connected to one side end of the plane portion 121-2 by a first connecting piece 122*a*-2 while a first communication hole 122*b*-2, through which a fluid is communicated between both spaces of the plane portion 121-2, is simultaneously provided among the one side end of the plane portion 121-2, the first connecting piece 122*a*-2, and the first guide piece 122-2.

A heat transfer medium inlet end of the second guide piece 123-2 is connected to the other side end of the plane portion 121-2 by a second connecting piece 123*a*-2 while a second communication hole 123*b*-2, through which a fluid is communicated between both spaces of the plane portion 121-2, is simultaneously provided among the other side end of the plane portion 121-2, the second connecting piece 123*a*-2, and the second guide piece 123-2.

The first guide piece 122-2 and the second guide piece 123-2 may be formed by cutting and bending parts of the plane portion 121-2 to both sides of the plane portion 121-2 to communicate a fluid between both spaces of the plane portion 121-2 through the cut portions of the plane portion 121-2.

Also, a first support portion 124-2 and a second support portion 125-2, which are located to be vertically spaced apart and protrude back and forth to come into contact with both sides of the tube 110-2, are formed on an upper end part and a lower end part of the turbulator 120-1-2, respectively.

Also, first support pieces 126-1 (126*a*-2 and 126*b*-2) and second support pieces 127-2 (127*a*-2 and 127*b*-2), which are located to be vertically spaced apart and protrude back and forth to come into contact with a front surface and a rear surface of the tube 110-2, are formed on an upper end part and a lower end part of the turbulator 120-1-2, respectively.

Since the dimples 111-2 (111*a*-2 and 111*b*-2) are formed in the tube 110-2 and the turbulator 110-2 includes the first support portion 124-2, the second support portion 125-2, the first support pieces 126-2, and the second support pieces 127-2, it is possible to prevent a tube from being deformed or damaged even in an environment with high water pressure such that the tube may be extensively applied to water heaters with a working pressure of 10 kg/cm$^2$ or above, commercial (large capacity) products, and the like other than boilers.

Fourth Embodiment

Referring to FIGS. 27 to 30, a tube assembly 100-4 for a tubular heat exchanger according to a fourth embodiment of the present invention has a difference in components of a pressure support portion in comparison to the above-described third embodiment and may include other components which are the same as those of the third embodiment. Accordingly, while components and operations of the tube assembly 100-4 for the tubular heat exchanger according to the fourth embodiment of the present invention are described, components equal to those of the above-described third embodiment will be referred to with the same reference numerals and a repetitive description thereof will be omitted.

The tube assembly 100-4 for the tubular heat exchanger according to the fourth embodiment of the present invention includes a tube 110-2 having a flat shape for exchanging heat between a combustion gas flowing along an inside thereof and a heat transfer medium flowing outside, a turbulator 120-2-2 combined with the inside of the tube 110-2 to induce turbulence to be generated in a flow of the combustion gas, and a pressure support portion formed inside the tube 110-2 for supporting both opposite sides of the tube 110-2 against external pressure applied thereto.

The pressure support portion includes supports 129-2 (129*a*-2 and 129*b*-2) which protrude outward from both sides of the turbulator 120-2-2 and come into contact with inner surfaces of the tube 110-2 facing each other.

The supports 129-2 includes a first support 129*a*-2 protruding forward from one side surface of the turbulator 120-2-2 and a second support 129*b*-2 protruding rearward from the other side surface of the turbulator 120-2-2. The first support 129*a*-2 and the second support 129*b*-2 are formed on both sides to be spaced apart, and a plurality of such first supports 129*a*-2 and a plurality of such second supports 129*b*-2 are formed at certain intervals along a longitudinal direction of the turbulator 120-2-2.

Since the plurality of first supports 129*a*-2 and the plurality of second supports 129*b*-2 are formed to be bent toward a front and a rear of the turbulator 120-2-2 as described above, the pressure support portion may be embodied without additional components such that manufacturing costs of a tube assembly having excellent pressure-resistant performance may be reduced.

Fifth Embodiment

Referring to FIGS. 31 to 34, a tube assembly 100-5 for a tubular heat exchanger according to the fifth embodiment of the present invention includes a tube 110-3 having a flat shape for exchanging heat between a combustion gas flowing along an inside thereof and a heat transfer medium flowing thereoutside and a turbulator 150-3 combined with the inside of the tube 110-3 and inducing turbulence to be generated in a flow of the combustion gas.

The turbulator 150-3 may include a plane portion 151-3 disposed in a longitudinal direction of the tube 110-3 while dividing an internal space of the tube 110-3 into both sides and include first guide pieces 152-3 and second guide pieces 153-3 alternately protruding from both sides of the plane portion 131-3 to be inclined while being spaced apart along the longitudinal direction.

The first guide pieces 152-3 are arranged on one side surface of the plane portion 151-3 to be inclined toward one side, and the second guide pieces 153-3 are arranged on the other side surface of the plane portion 151-3 to be inclined toward the other side. Accordingly, the heat transfer medium, which has flowed into the first guide pieces 152-3 and the second guide pieces 153-3, is sequentially transferred to the second guide pieces 153-3 and the first guide pieces 152-3 adjacently arranged on opposite sides of the plane portion 151-3 and alternately flows through both spaces of the plane portion 151-3.

A heat transfer medium inlet end of the first guide piece 152-3 is connected to one side end of the plane portion 151-3 by a first connecting piece 152*a*-3 while a first communication hole 152*b*-3, through which a fluid is communicated between both spaces of the plane portion 151-3, is simultaneously provided among the one side end of the plane portion 151-3, the first connecting piece 152*a*-3, and the first guide piece 152-3.

A heat transfer medium inlet end of the second guide piece 153-3 is connected to the other side end of the plane portion 151-3 by a second connecting piece 153*a*-3 while a second communication hole 153*b*-3, through which a fluid is communicated between both spaces of the plane portion 151-3, is simultaneously provided among the other side end of the plane portion 151-3, the second connecting piece 153*a*-3, and the second guide piece 153-3.

The first guide piece 152-3 and the second guide piece 153-3 may be formed by cutting and bending parts of the plane portion 151-3 to both sides of the plane portion 151-3 to communicate a fluid between both spaces of the plane portion 151-3 through the cut portions of the plane portion 151-3.

Also, welding portions 154-3 and 155-3 protrude ambilaterally from the plane portion 151-3 to come into an inner surface of the tube 110-3 such that the welding portions 154-3 and 155-3 and the inner surface of the tube 110-3 may be welded to and combined with each other. Accordingly, an area and a spot of a welding part between the turbulator 150-3 and the tube 110-3 may be reduced.

According to the above-described components of the turbulator 150-3, as an arrow shown in FIG. 32B, since a flow direction of a combustion gas is continuously changed to one side and the other side in an internal space of the tube 110-3 by the first guide piece 152-3 and the second guide piece 153-3 such that a turbulent flow is promoted, efficiency of heat exchange between the combustion gas and the heat transfer medium may be increased.

Meanwhile, during a process in which the combustion gas sequentially passes through the above-described sensible heat exchanger 1000*a* and latent heat exchanger 1000*b* shown in FIG. 10, a temperature of the combustion gas is gradually decreased by heat exchange with the heat transfer medium. Accordingly, the temperature of the combustion gas is high in the sensible heat exchanger 1000*a* into which the combustion gas flows such that a volume thereof expands. The temperature of the combustion gas is low in the latent heat exchanger 1000*b* from which the combustion gas is discharged such that the volume is reduced.

Accordingly, in order to increase efficiency of heat exchange, flow resistance of the combustion gas may be reduced by forming a large flow path area of the combustion gas passing through the sensible heat exchanger 1000*a* and a flow path area of the combustion gas may be formed to be relatively small in the latent heat exchanger 1000*b*.

As components for this purpose, the turbulator 150-3 has an integral structure including an upper turbulator 150*a*-3 provided at an inlet side of the combustion gas and a lower turbulator 150*b*-3 provided at an outlet side of the combustion gas. Here, in order to form a flow path area between the lower turbulator 150*b*-3 and the inner surface of the tube 110-3 to be smaller than a flow path area between the upper turbulator 150*a*-3 and the inner surface of the tube 110-3, the lower turbulator 150*b*-3 may have a larger area in contact with the heat transfer medium inside the tube 110-3 than that of the upper turbulator 150*a*-3.

As one embodiment, as shown in FIG. 32, vertical intervals L2 between the plurality of first guide pieces 152-3 and the plurality of second guide pieces 153-3 formed on the lower turbulator 150*b*-3 may be more densely arranged than vertical intervals 11 between the plurality of first guide pieces 152-3 and the plurality of the second guide pieces 153-3 formed on the upper turbulator 150*a*-3.

In this case, the vertical intervals between the plurality of first guide pieces 152-3 and the plurality of the second guide pieces 153-3 formed on the turbulator 150-3 may be formed to be gradually decreased from the inlet side of the combustion gas toward the outlet side of the combustion gas.

As another embodiment, as shown in FIG. 33, a plurality of protruding portions 111-3 are formed on the inner surface of the tube 110-3 located on the outlet side of the combustion gas so as to reduce the flow path area of the outlet side of the combustion gas.

Referring to FIG. 34, support portions 142-3 (142*a*-3, 142*b*-3, and 142*c*-3) for supporting against water pressure of the heat transfer medium may be additionally provided inside the tube 110-3.

The supports 142-3 may include a bar-shaped support 142*a*-3 having both ends fixed to the inner surface of the tube 110-3 as shown in FIG. 34A and a support 142*b*-3 having both ends bent and fixed to the inner surface of the tube 110-3 as shown in FIGS. 34B and 34C.

In the case of a structure shown in FIGS. 34A and 34B, when the tube 110-3 is manufactured, one ends of the supports 142*a*-3 and 142*b*-3 are welded to a basic material of which the tube 110-3 will be formed, the basic material is manufactured to be rolled like a shape of the tube 110-3, both end parts of the basic material and the other ends of the support 142*a*-3 and 142*b*-3 are welded to one another, and then the turbulator 150-3 is inserted into and combined with both sides of the supports 142*a*-3 and 142-3.

In the case of a structure shown in FIG. 34C, when the tube 110-3 is manufactured, the support 142*b*-3 and the turbulator 150-3 may be combined with each other first and a combination of the support 142*b*-3 and the turbulator 150-3 may be press-fit on and combined with the inside of the tube 110-3.

As another embodiment, as shown in FIG. 34D, the support 142-3 may include embossings 142*c*-3 formed to protrude toward the inside of a tube 140 from both corresponding sides of the tube 110-3. According to the components, when high water pressure is applied from the outside of the tube 110-3, the embossings 142*c*-3 formed in the corresponding positions come into contact with each other so as to prevent the tube 110-3 from being deformed.

As described above, when the support portion 142-3 is combined with the inside of the tube 110-3 such that the water pressure of the heat transfer medium is highly applied to an outer surface of the tube 110-3, deformation of the tube 110-3 may be prevented. Accordingly, the tube 110-3 combined with the support portion 142-3 may be applied to combustion devices for a variety of purposes in addition to a boiler or a water heater.

Six Embodiment

Referring to FIGS. 35 to 38, a tube assembly 100-6 for a tubular heat exchanger according to a sixth embodiment of the present invention includes a tube 110-4 having a flat shape for exchanging heat between a combustion gas flowing along an inside thereof and a heat transfer medium flowing outside, a turbulator 120-1-4 combined with the inside of the tube 110-4 to induce turbulence to be generated in a flow of the combustion gas, and a supporter 130-1-4 combined with the turbulator 120-1-4 and supporting the tube 110-4 against external pressure applied thereto.

Components and an assembling structure of the turbulator 120-1-4 and the supporter 130-1-4 included in the tube assembly 100-6 according to the sixth embodiment of the present invention will be described.

A slit 132-4 (132-1-4) having a shape with a blocked upper end and an open lower end 132*c*-4 is formed in a central part of a body portion 131-4 of the supporter 130-1-4 as shown in FIG. 38 and the turbulator 120-1-4 is inserted into a slit 132-1-4 formed in the supporter 130-1-4 in a major direction as shown in FIG. 37 such that the turbulator 120-1-4 and the supporter 130-1-4 are assembled.

The slit 132-1-4 has a structure in which a first cut portion 132*a*-4 having a width to come into contact with both side surfaces of the turbulator 120-1-4 and a second cut portion 132*b*-4 having a larger width than that of the first cut portion 132*a*-4 are vertically connected and alternately formed. Accordingly, the both side surfaces of the turbulator 120-1-4 come into close contact with and are supported by the first cut portion 132*a*-4, and a combustion gas may flow through a space provided between the second cut portion 132*b*-4 and the turbulator 120-1-4.

Also, a plurality of protruding portions 133-4, which protrude and have an uneven shape to come into contact with an inner surface of the tube 110-4, are provided to be vertically spaced apart on an outer end of the supporter 130-1-4. According to the components of the protruding portions 133-4, since a contact area between the supporter 130-1-4 and the tube 110-4 is restricted to an area in which the protruding portions 133-4 are formed, the contact area may be reduced. Accordingly, sine it is possible to prevent occurrence of crevice corrosion which may be caused by congestion of a heat transfer medium due to surface tension when a contact area between a supporter and a tube is large, durability of a tube assembly may be increased.

The turbulator 120-1-4 may include a plane portion 121-4 disposed in a longitudinal direction of the tube 110-4 while dividing an internal space of the tube 110-4 into both sides and include first guide pieces 122-4 and second guide pieces 123-4 alternately protruding from both sides of the plane portion 121-4 to be inclined while being spaced apart along the longitudinal direction.

The first guide pieces 122-4 are arranged on one side surface of the plane portion 121-4 to be inclined toward one side, and the second guide pieces 123-4 are arranged on the other side surface of the plane portion 121-4 to be inclined toward the other side. Accordingly, the heat transfer medium, which has flowed into the first guide pieces 122-4 and the second guide pieces 123-4, is sequentially transferred to the second guide pieces 123-4 and the first guide pieces 122-4 adjacently arranged on opposite sides of the plane portion 121-4 and alternately flows through both spaces of the plane portion 121-4.

A heat transfer medium inlet end of the first guide piece 122-4 is connected to one side end of the plane portion 121-4 by a first connecting piece 122*a*-4 while a first communication hole 122*b*-4, through which a fluid is communicated between both spaces of the plane portion 121-4, is simultaneously provided among the one side end of the plane portion 121-4, the first connecting piece 122*a*-4, and the first guide piece 122-4.

A heat transfer medium inlet end of the second guide piece 123-4 is connected to the other side end of the plane portion 121-4 by a second connecting piece 123*a*-4 while a second communication hole 123*b*-4, through which a fluid is communicated between both spaces of the plane portion 121-4, is simultaneously provided among the other side end of the plane portion 121-4, the second connecting piece 123*a*-4, and the second guide piece 123-4.

The first guide piece 122-4 and the second guide piece 123-4 may be formed by cutting and bending parts of the plane portion 121-4 to both sides of the plane portion 121-4 to communicate a fluid between both spaces of the plane portion 121-4 through the cut portions of the plane portion 121-4.

Also, a first support portion 124-4 and a second support portion 125-4, which are located to be vertically spaced apart and protrude back and forth to come into contact with both sides of the tube 110-4, are formed on an upper end part and a lower end part of the turbulator 120-1-4, respectively.

Also, a plurality of pairs of first support pieces 126-4 and a plurality of pairs of second support pieces 127-4, which protrude to support both side surfaces of the supporter 130-1-4, are vertically spaced apart on both side surfaces of the turbulator 120-1-4.

Accordingly, when the turbulator 120-1-4 is inserted into the slit 132-1-4 of the supporter 130-1-4 in a major direction, since the supporter 130-1-4 is supported by the first support piece 126-4 and the second support 127-4, positions of the turbulator 120-1-4 and the supporter 130-1-4 may be fixed.

According to the above-described components of the turbulator 120-1-4, since a flow direction of a combustion gas is continuously changed to one side and the other side in an internal space of the tube 110-4 by the first guide piece 122-4 and the second guide piece 123-4 such that a turbulent flow is promoted, efficiency of heat exchange between the combustion gas and the heat transfer medium may be increased.

Seventh Embodiment

Referring to FIGS. 39 to 41, a tube assembly 100-7 for a tubular heat exchanger according to a seventh embodiment of the present invention includes the tube 110-4 having a flat shape for exchanging heat between a combustion gas flowing along an inside thereof and a heat transfer medium flowing outside, a turbulator 120-2-4 combined with the inside of the tube 110-4 to induce turbulence to be generated in a flow of the combustion gas, and a supporter 130-2-4 combined with the turbulator 120-2-4 and for supporting the tube 110-4 against external pressure applied thereto.

Hereinafter, while components and an assembling structure of the turbulator 120-2-4 and the supporter 130-2-4 included in the tube assembly 100-7 for the tubular heat exchanger according to the seventh embodiment of the present invention are described, components equal to those of the above-described sixth embodiment will be referred to as the same reference numerals and a repetitive description thereof will be omitted.

In the embodiment, a slit 132-2-4 having a shape with blocked upper and lower ends is formed in the body portion 131-4 of the supporter 130-2-4 as shown in FIG. 41, and the turbulator 120-2-4 and the supporter 130-2-4 are assembled by inserting the turbulator 120-2-4 into an inside of the slit 132-2-4 formed in the supporter 130-2-4 in a minor direction as shown in FIG. 40.

The slit 132-2-4 has a structure in which a first cut portion **132*d*-4 having a width to come into contact with both side surfaces of the turbulator 120-2-4 and a second cut portion 132*e*-4 having a larger width than that of the first cut portion 132*d*-4** are vertically connected and alternately formed.

Accordingly, the both side surfaces of the turbulator 120-2-4 come into close contact with and are supported by the first cut portion **132*d*-4, and a combustion gas may flow through a space provided between the second cut portion 132*e*-4 and the turbulator 120-2-4**.

In the embodiment, a holding piece **128*a*-4 and a holding protrusion 128*b*-4, which protrude to support both side surfaces of the supporter 130-2-4, are formed on each of an upper end part and a lower end part of the turbulator 120-2-4**.

The holding piece **128*a*-4 may be formed by cutting and vertically bending a part of the plane portion 121-4, and the holding protrusion 128*b*-4 may be provided in a position spaced as much as a distance corresponding to a thickness of the supporter 130-2-4 apart toward one side of the holding piece 128*a*-4 while having an embossing shape. Accordingly, when the turbulator 120-2-4 is inserted into an inside of the slit 132-2-4 formed in the supporter 130-2-4 in a minor direction, the holding protrusion 128*b*-4 passes through a through portion 132*f*-4 formed in the slit 132-2-4 and having the same shape as that of the holding protrusion 128*b*-4. Here, since the holding piece 128*a*-4 comes into close contact with the body portion 131-4 of the supporter 130-2-4, the supporter 130-2-4 is supported by the holding piece 128*a*-4 and the holding protrusion 128*b*-4 so as to fix positions of the turbulator 120-2-4 and the supporter 130-2-4**.

Eighth Embodiment

Referring to FIGS. 42 to 44, a tube assembly 100-8 for a tubular heat exchanger according to an eighth embodiment of the present invention includes the tube 110-4 having a flat shape for exchanging heat between a combustion gas flowing along an inside thereof and a heat transfer medium flowing outside, a turbulator 120-3-4 combined with the inside of the tube 110-4 to induce turbulence to be generated in a flow of the combustion gas, and a supporter 130-3-4 combined with the turbulator 120-3-4 and for supporting the tube 110-4 against external pressure applied thereto.

Hereinafter, while components and an assembling structure of the turbulator 120-3-4 and the supporter 130-3-4 included in the tube assembly 100-8 for the tubular heat exchanger according to the eighth embodiment of the present invention are described, components equal to those of the above-described sixth embodiment and the seventh embodiment will be referred to as the same reference numerals and a repetitive description thereof will be omitted.

In the embodiment, a plurality of slits 129-4 vertically spaced apart are formed in the plane portion 121-4 of the turbulator 120-3-4 as shown in FIG. 44, and the turbulator 120-3-4 and the supporter 130-3-4 are assembled by vertically inserting one part of the supporter 130-3-4 into the inside of the slit 129-4 formed in the turbulator 120-3-4.

Blockage portions **129*a*-4 are formed on the turbulator 120-3-4 in intervals of the adjacently located slits 129-4, and a plurality of support grooves 135-4 held by the blockage portions 129*a*-4 are formed on the supporter 130-3-4**.

Also, a plurality of protruding portions 134-4, which protrude to come into contact with an inner surface of the tube 110-4 are provided on an outer end of the supporter 130-3-4 while being vertically spaced apart such that crevice corrosion may be prevented by reducing a contact area between the tube 110-4 and the supporter 130-3-4.

As described above, the present invention is not limited to the above-described embodiments, and it is appreciated that a variety of modifications of the present invention may be made by one of ordinary skill in the art without departing from the technical concept of the present invention defined by the claims and the variety of modifications will be included in the scope of the present invention.

The invention claimed is:

1. A tube assembly for a tubular heat exchanger, comprising:

a tube having a flat shape to allow a combustion gas generated in a combustion chamber to flow along an inside thereof and to exchange heat between the combustion gas and a heat transfer medium flowing there outside; and a turbulator combined with the inside of the tube and configured to induce turbulence to be generated in a flow of the combustion gas, wherein the turbulator comprises:

an upper turbulator combined with an upper inside of the tube adjacent to the combustion chamber to come into surface contact with the tube to increase heat conductivity and induce turbulence to be generated in a flow of the combustion gas; and a lower turbulator combined with the inside of the tube below the upper turbulator to induce turbulence to be generated in a flow of the combustion gas;

wherein the upper turbulator comprises a first part comprising a first tube contact surface having a shape corresponding to one side part of the tube and coming into surface contact with an inner surface of the one side part of the tube and comprises a second part comprising a second tube contact surface having a shape corresponding to the other side part of the tube and coming into surface contact with an inner surface of the other side part of the tube;

wherein the upper turbulator comprises a first pressure support portion formed by bending a part of a first cut portion cut from the first tube contact surface and protruding toward the second tube contact surface and comprises a second pressure support portion formed by bending a part of a second cut portion cut from the second tube contact surface and protruding toward the first tube contact surface, and wherein a protruding end of the first pressure support portion comes into contact with the second tube contact surface, and a protruding end of the second pressure support portion passes through the first cut portion and comes into contact with an inner surface of the tube.

2. The tube assembly of claim 1, wherein a plurality of such first pressure support portions and a plurality of such second pressure support portions are provided to be spaced apart laterally and in a vertical direction, wherein an above-located first pressure support portion and a below-located first pressure support portion are provided in positions not overlapped with each other in a vertical direction, and wherein an above-located second pressure support portion and a below-located second pressure support portion are provided in positions not overlapped with each other in a vertical direction.

3. The tube assembly of claim 2, wherein the first pressure support portion and the second pressure support portion have a plate shape and include both large side surfaces arranged in parallel with the flow direction of the combustion gas.

4. The tube assembly of claim 1, wherein the turbulator comprises a plane portion dividing an internal space of the tube and disposed in a longitudinal direction of the tube and comprises a plurality of first guide pieces and a plurality of second guide pieces which are spaced apart along a longitudinal direction and alternately protrude from both side surfaces of the plane portion to be inclined.

5. The tube assembly of claim 4, wherein the first guide pieces are arranged on one side surface of the plane portion to be inclined toward one side, wherein the second guide pieces are arranged on the other surface of the plane portion to be inclined toward the other side, and wherein the combustion gas flowing into the first guide pieces and the second guide pieces is sequentially transferred to the second guide piece and the first guide piece arranged to be adjacent to an opposite side surface of the plane portion and alternately flows on both spaces of the plane portion.

6. The tube assembly of claim 5, wherein a heat transfer medium inlet end of the first guide piece is connected to one side end of the plane portion by a first connecting piece while a first communication hole, through which a fluid is communicated between the both spaces of the plane portion, is simultaneously provided among the one side end of the plane portion, the first connecting piece, and the first guide piece, and wherein a heat transfer medium inlet end of the second guide piece is connected to the other side end of the plane portion by a second connecting piece while a second communication hole, through which a fluid is communicated between the both spaces of the plane portion, is simultaneously provided among the other side end of the plane portion, the second connecting piece, and the second guide piece.

7. The tube assembly of claim 5, wherein the first guide piece and the second guide piece are formed by cutting and bending parts of the plane portion toward both sides of the plane portion, and wherein a fluid is communicated between the both spaces of the plane portion through cut parts of the first guide piece and the second guide piece.

8. The tube assembly of claim 1, wherein support pieces, which are located to be vertically spaced apart to come into contact with a front surface and a rear surface of the tube and protrude back and forth, are formed at an upper end part and a lower end part of the lower turbulator.

9. The tube assembly of claim 1, further comprising a pressure support portion formed inside the tube to support both opposite side surfaces of the tube against external pressure applied thereto.

10. The tube assembly of claim 9, wherein the pressure support portion comprises supports which protrude outward from the both side surfaces of the turbulator and come into contact with inner surfaces of the tube facing each other.

11. The tube assembly of claim 10, wherein the supports are formed by cutting and bending parts of a surface of the turbulator to both sides.

12. A tubular heat exchanger comprising:

an external jacket which a heat transfer medium flows into or discharges from;

a combustion chamber which is combined with an inside of the external jacket to form a flow path of the heat transfer medium between the external jacket and the combustion chamber and in which combustion of a burner is performed; and the tube assembly for the tubular heat exchanger according to claim 1.

13. The tubular heat exchanger of claim 12, wherein a plurality of such tubes are vertically installed so as to allow a combustion gas generated in the combustion chamber to flow downward, are spaced apart in a circumferential direction, and are radially arranged.

14. The tubular heat exchanger of claim 12, wherein a multistage diaphragm for guiding a flow of the heat transfer medium to alternately change a flow direction of the heat transfer medium to be inside or outside in a radial direction are provided to be vertically spaced apart in the external jacket, and a plurality of such tubes are inserted into and supported by the multistage diaphragm.

15. The tubular heat exchanger of claim 14, wherein the multistage diaphragm comprises an upper diaphragm, an intermediate diaphragm, and a lower diaphragm which have a plate shape, wherein the upper diaphragm and the lower diaphragm comprise an opening portion for a flow of the heat transfer medium in a central part thereof and an edge part to come into contact with an inner surface of the external jacket, and wherein the intermediate diaphragm has a shape in which a central part is blocked and an edge part is spaced apart from the inner surface of the external jacket to allow the heat transfer medium to flow therebetween.

16. The tubular heat exchanger of claim 14, wherein an upper tube sheet, into which upper end parts of the plurality of tubes are inserted, is combined with a lower end of the combustion chamber, and wherein a lower tube sheet, into which lower end parts of the plurality of tubes are inserted, is combined with a lower end of the external jacket.

* * * * *